US010907226B2

(12) United States Patent
Verma

(10) Patent No.: US 10,907,226 B2
(45) **Date of Patent: *Feb. 2, 2021**

(54) METHODS OF MODIFYING MATERIAL PROPERTIES OF WORKPIECES USING HIGH-PRESSURE-TORSION APPARATUSES

(71) Applicant: The Boeing Company, Chicago, IL (US)

(72) Inventor: Ravi Verma, Chesterfield, MO (US)

(73) Assignee: The Boeing Company, Chicago, IL (US)

( * ) Notice: Subject to any disclaimer, the term of this patent is extended or adjusted under 35 U.S.C. 154(b) by 215 days.

This patent is subject to a terminal disclaimer.

(21) Appl. No.: 16/227,516

(22) Filed: Dec. 20, 2018

(65) Prior Publication Data

US 2020/0199699 A1 Jun. 25, 2020

(51) Int. Cl.
*C21D 1/84* (2006.01)
*C21D 7/13* (2006.01)
(Continued)

(52) U.S. Cl.
CPC ..... *C21D 1/84* (2013.01); *C21D 1/613* (2013.01); *C21D 1/673* (2013.01); *C21D 7/13* (2013.01);
(Continued)

(58) Field of Classification Search
CPC ..... C21D 1/613; C21D 1/673; C21D 1/84; C21D 2221/00; C21D 7/13; C21D 8/06;
(Continued)

(56) References Cited

U.S. PATENT DOCUMENTS 4,437,329 A * 3/1984 Geppelt ..... B21D 11/14 72/299

7,115,177 B2 * 10/2006 Appel ..... B21J 1/025 148/639

(Continued)

FOREIGN PATENT DOCUMENTS

| | | | |
|---|---|---|---|
| EP | 1214995 | A2 | 6/2002 |
| EP | 1570924 | B1 | 8/2009 |
| JP | 2009131884 | A | 6/2009 |

OTHER PUBLICATIONS

Azushima, A. et al.; Severe Plastic Deformation (SPD) Processes for Metals; CIRP Annals—Manufacturing Technology 57 (2008), pp. 716-735.

(Continued)

*Primary Examiner* — Scott R Kastler
*Assistant Examiner* — Michael Aboagye
(74) *Attorney, Agent, or Firm* — Kwan & Olynick LLP

(57) ABSTRACT

Described is a method of modifying material properties of a workpiece using a high-pressure-torsion apparatus, comprising a working axis, a first anvil, a second anvil, and an annular body, comprising a first total-loss convective chiller, a second total-loss convective chiller, and a heater, positioned between the first total-loss convective chiller and the second total-loss convective chiller along the working axis. The method comprises compressing the workpiece along a central axis of the workpiece and, simultaneously with compressing the workpiece along the central axis, twisting the workpiece about the central axis. The method further comprises, while compressing the workpiece along the central axis and twisting the workpiece about the central axis, translating the annular body along the working axis of the high-pressure-torsion apparatus, collinear with the central axis of the workpiece, and heating the workpiece with the heater.

23 Claims, 18 Drawing Sheets

(51) Int. Cl.

| | |
|---|---|
| ***C21D 1/613*** | (2006.01) |
| ***C21D 1/673*** | (2006.01) |
| ***C21D 8/06*** | (2006.01) |
| ***C21D 9/00*** | (2006.01) |

(52) U.S. Cl.
CPC ..... *C21D 8/06* (2013.01); *C21D 9/0075* (2013.01); *C21D 2201/05* (2013.01); *C21D 2221/00* (2013.01)

(58) Field of Classification Search
CPC ..... C21D 9/0075; B21D 11/14; B21D 11/22; B21J 1/003; B21J 1/02; B21J 1/025
USPC ..... 148/558, 714, 302, 294, 639, 670, 671, 148/643, 640; 72/64, 342.5, 342.94, 710, 72/248, 371
See application file for complete search history.

(56) References Cited

U.S. PATENT DOCUMENTS 7,559,221 B2 * 7/2009 Horita ..... B21J 1/025 72/342.6
8,394,214 B2 * 3/2013 Nakamura ..... C22F 1/00 148/559
2020/0199700 A1 * 6/2020 Verma ..... C21D 9/08
2020/0199701 A1 * 6/2020 Verma ..... C21D 7/13

OTHER PUBLICATIONS

European Application Serial No. 19200310.1, Search Report dated May 4, 2020, 6 pgs.
European Application Serial No. 19200600.5, Search Report dated Apr. 17, 2020, 6 pgs.
European Application Serial No. 19200602.1, Search Report dated Apr. 20, 2020, 6 pgs.
Edalati, Kaveh et al., "A review on high-pressure torsion (HPT) from 1935 to 1988", Materials Science and Engineering A 652, 2016, pp. 325-352.
Hohenwarter, A. , "Incremental high pressure torsion as a novel severe plastic deformation process: Processing features and application to copper", Materials Science and Engineering A 626, 2015, pp. 80-85.
Verma, Ravi , "High-Pressure-Torsion Apparatuses and Methods of Modifying Material Properties of Workpieces Using Such Apparatuses", U.S. Appl. No. 16/227,531, filed Dec. 20, 2018, 101 pgs.
Verma, Ravi , "High-Pressure-Torsion Apparatuses and of Modifying Material Properties of Workpieces Using Such Apparatuses", U.S. Appl. No. 16/227,543, filed Dec. 20, 2018, 78 pgs.

* cited by examiner (Continued to FIG. 8B)

METHODS OF MODIFYING MATERIAL PROPERTIES OF WORKPIECES USING HIGH-PRESSURE-TORSION APPARATUSES

BACKGROUND

High-pressure torsion is a technique, used to control grain structures in workpieces. However, requirements for high pressure and high torque have limited this technique to workpieces, having specific geometric constraints—for example, disks, having thicknesses of about 1 millimeter or less. Such workpieces have limited practical applications, if any. Moreover, scaling the workpiece size proved to be difficult. Incremental processing of elongated workpieces has been proposed, but has not been successfully implemented.

SUMMARY

Accordingly, apparatuses and methods, intended to address at least the above-identified concerns, would find utility.

The following is a non-exhaustive list of examples, which may or may not be claimed, of the subject matter, disclosed herein.

One example of the subject matter, disclosed herein, relates to a high-pressure-torsion apparatus, comprising a working axis, a first anvil, a second anvil, and an annular body. The second anvil faces the first anvil and is spaced apart from the first anvil along the working axis. The first anvil and the second anvil are translatable relative to each other along the working axis. The first anvil and the second anvil are rotatable relative to each other about the working axis. The annular body comprises a first total-loss convective chiller, a second total-loss convective chiller, and a heater. The first total-loss convective chiller is translatable between the first anvil and the second anvil along the working axis. The first total-loss convective chiller is configured to be thermally convectively coupled with a workpiece and is configured to selectively cool the workpiece. The second total-loss convective chiller is translatable between the first anvil and the second anvil along the working axis. The second total-loss convective chiller is configured to be thermally convectively coupled with the workpiece and is configured to selectively cool the workpiece. The heater is positioned between the first total-loss convective chiller and the second total-loss convective chiller along the working axis. The heater is translatable between the first anvil and the second anvil along the working axis and is configured to selectively heat the workpiece.

High-pressure-torsion apparatus 100 is configured to process workpiece 190 by heating a portion of workpiece 190 while applying the compression and torque to workpiece 190 to this heated portion. By heating only a portion of workpiece 190, rather than heating and processing workpiece 190 in its entirety at the same time, all of high-pressure-torsion deformation is confined to the narrow heated layer only, imparting high strains needed for fine-grain development. This reduction in compression and torque translates into a design of high-pressure-torsion apparatus 100 that is less complex and costly. Furthermore, this reduction in compression and torque results in more precise control over processing parameters, such as temperature, compression load, torque, processing duration, and the like. As such, more specific and controlled material microstructures of workpiece 190. For example, ultrafine grained materials offer substantial advantage over coarser grained materials displaying higher strength and better ductility. Finally, high-pressure-torsion apparatus 100 is able to process workpiece 190 having much large dimensions, e.g., a length, extending along working axis 102 of high-pressure-torsion apparatus 100, than would otherwise be possible if workpiece 190 is processed in its entirety at the same time.

A stacked arrangement of first total-loss convective chiller 140, heater 160, and second total-loss convective chiller 150 allows controlling size and position of each processed portion of workpiece 190. A processed portion generally corresponds to a heated portion, defined, at least in part, by the position of heater 160 relative to workpiece 190 and the heating output of heater 160. While compression and torque are applied to workpiece 190 in its entirety, the modification of material properties primarily happens in the heated portion. More specifically, the modification happens in a processed portion, which has a temperature within a desired processing range, which is defined as operating temperature zone 400. Various examples of operating temperature zone 400 are shown in FIGS. 4A-4C.

When first total-loss convective chiller 140 and/or second total-loss convective chiller 150 are operational, the heated portion of workpiece 190 is adjacent to a first cooled portion and/or a second cooled portion. The first cooled portion is defined, at least in part, by the position of first total-loss convective chiller 140 relative to workpiece 190 and the cooling output of first total-loss convective chiller 140. The second cooled portion is defined, at least in part, by the position of second total-loss convective chiller 150 relative to workpiece 190 and the cooling output of second total-loss convective chiller 150. The first cooled portion and/or the second cooled portion are used to control the internal heat transfer within workpiece 190, thereby controlling some characteristics of the processed portion and the shape of operating temperature zone 400, shown in FIGS. 4A-4C First total-loss convective chiller 140, heater 160, and second total-loss convective chiller 150 are translatable along working axis 102 to process different portions of workpiece 190, along central axis 195 of workpiece 190 defining the length of workpiece 190. As a result, high-pressure-torsion apparatus 100 is configured to process workpiece 190 with a large length relative to conventional pressure-torsion techniques, e.g., when workpiece 190 is processed in its entirety.

Another example of the subject matter, disclosed herein, relates to a high-pressure-torsion apparatus, comprising a working axis, a first anvil, a second anvil, and a heater. The second anvil faces the first anvil and is spaced apart from the first anvil along the working axis. The first anvil and the second anvil are translatable relative to each other along the working axis. The first anvil and the second anvil are rotatable relative to each other about the working axis. The heater is movable between the first anvil and the second anvil along the working axis and is configured to selectively heat a workpiece.

High-pressure-torsion apparatus 100 is configured to process workpiece 190 by heating a portion of workpiece 190 while applying the compression and torque to workpiece 190 to this heated portion. By heating only a portion of workpiece 190, rather than heating and processing workpiece 190 in its entirety at the same time, all of high-pressure-torsion deformation is confined to the narrow heated layer only, imparting high strains needed for fine-grain development. This reduction in compression and torque translates into a design of high-pressure-torsion apparatus 100 that is less complex and costly. Furthermore, this reduction in compression and torque results in more precise control over processing parameters, such as temperature, compression load, torque, processing duration, and the like. As such, more specific and controlled material microstructures of workpiece 190. For example, ultrafine grained materials offer substantial advantage over coarser grained materials displaying higher strength and better ductility. Finally, high-pressure-torsion apparatus 100 is able to process workpiece 190 having much large dimensions, e.g., a length, extending along working axis 102 of high-pressure-torsion apparatus 100, than would otherwise be possible if workpiece 190 is processed in its entirety at the same time. Specifically, heater 160 is movable along working axis 102.

Another example of the subject matter, disclosed herein, relates to a method of modifying material properties of a workpiece using a high-pressure-torsion apparatus, comprising a working axis, a first anvil, a second anvil, and an annular body. The annular body of the high-pressure-torsion apparatus comprises a first total-loss convective chiller, a second total-loss convective chiller, and a heater, positioned between the first total-loss convective chiller and the second total-loss convective chiller along the working axis. The method comprises compressing the workpiece along a central axis of the workpiece and, simultaneously with compressing the workpiece along the central axis, twisting the workpiece about the central axis. The method further comprises, while compressing the workpiece along the central axis and twisting the workpiece about the central axis, translating the annular body along the working axis of the high-pressure-torsion apparatus, collinear with the central axis of the workpiece, and heating the workpiece with the heater.

Method 800 utilizes a combination of compression, torque, and heat applied to a portion of workpiece 190, rather than workpiece 190 in its entirety. By heating only a portion of workpiece 190, rather than heating and processing workpiece 190 in its entirety at the same time, all of high-pressure-torsion deformation is confined to the narrow heated layer only, imparting high strains needed for fine-grain development. This reduction in compression and torque translates into a design of high-pressure-torsion apparatus 100) that is less complex and costly. Furthermore, this reduction in compression and torque results in more precise control over processing parameters, such as temperature, compression load, torque, processing duration, and the like. As such, more specific and controlled material microstructures of workpiece 190. For example, ultrafine grained materials offer substantial advantage over coarser grained materials displaying higher strength and better ductility. Finally, high-pressure-torsion apparatus 100 is able to process workpiece 190 having much large dimensions, e.g., a length, extending along working axis 102 of high-pressure-torsion apparatus 100, than would otherwise be possible if workpiece 190 is processed in its entirety at the same time.

A processed portion generally corresponds to a heated portion, defined, at least in part, by the position of heater 160 relative to workpiece 190 and the heating output of heater 160. While compression and torque are applied to workpiece 190 in its entirety, the modification of material properties primarily happens in the heated portion. More specifically, the modification happens in a processed portion, which has a temperature within a desired processing range, which is defined as operating temperature zone 400. Various examples of operating temperature zone 400 are shown in FIGS. 4A-4C.

BRIEF DESCRIPTION OF THE DRAWINGS

Figure 1A:
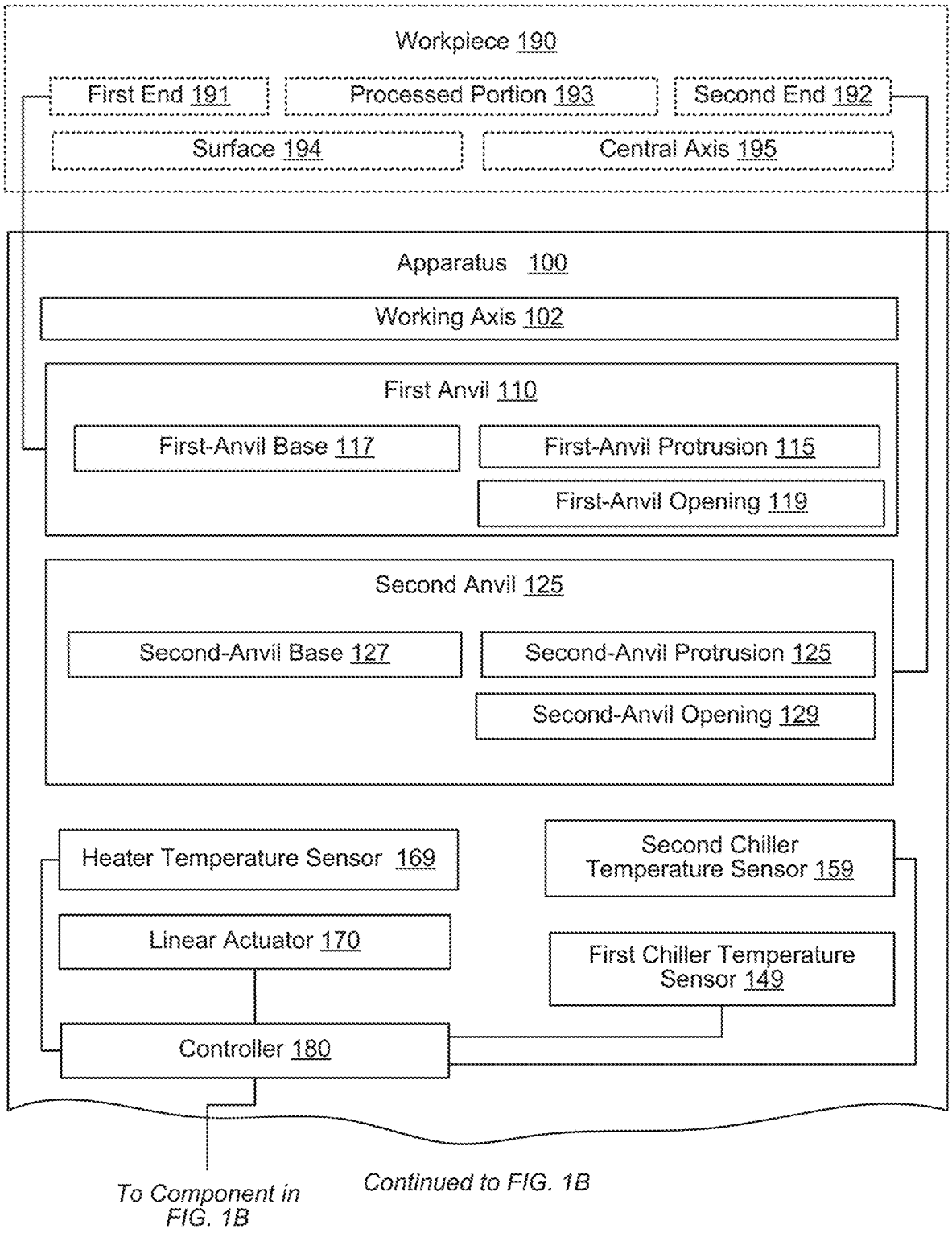
Figure 1B:
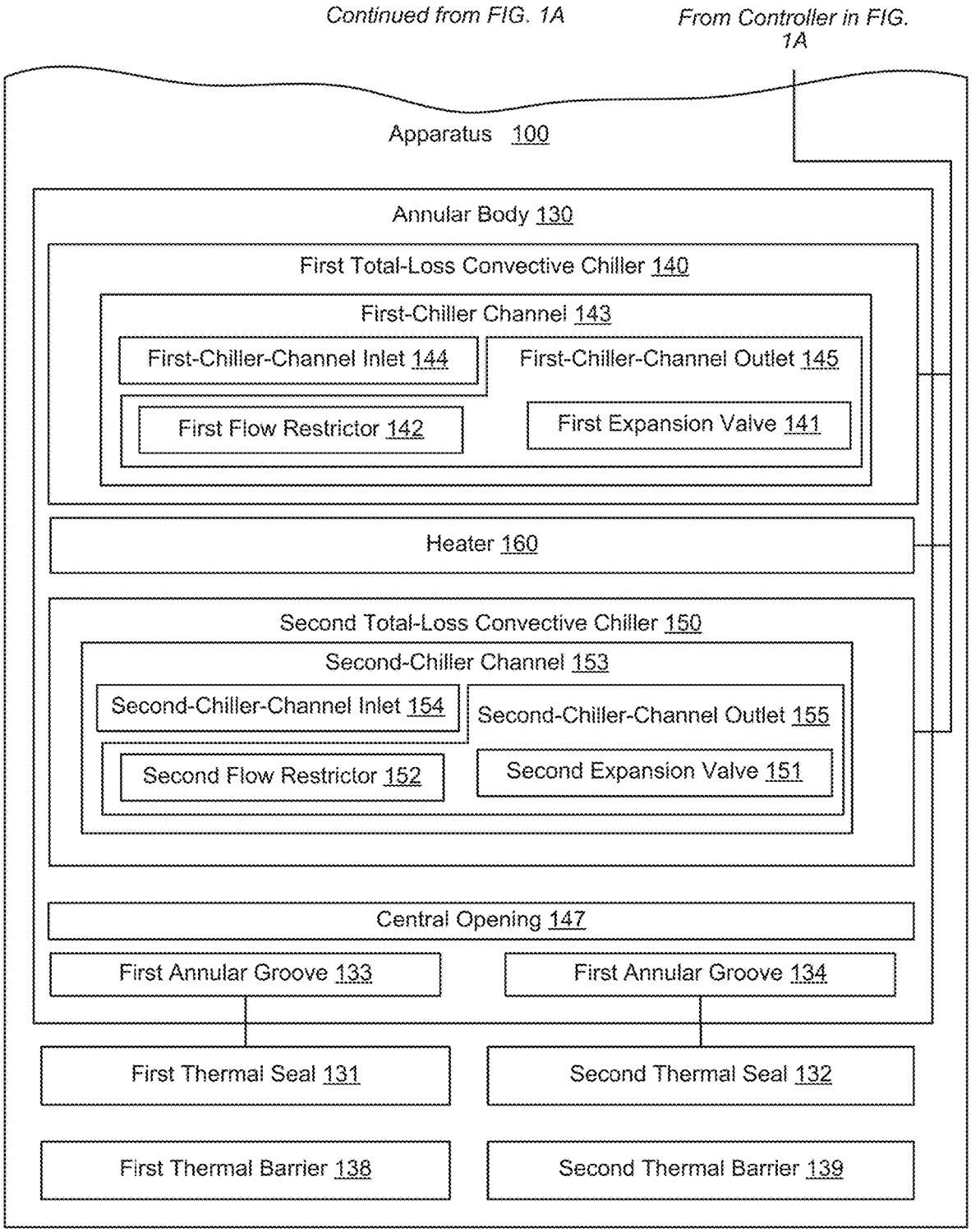
Figure 2A:
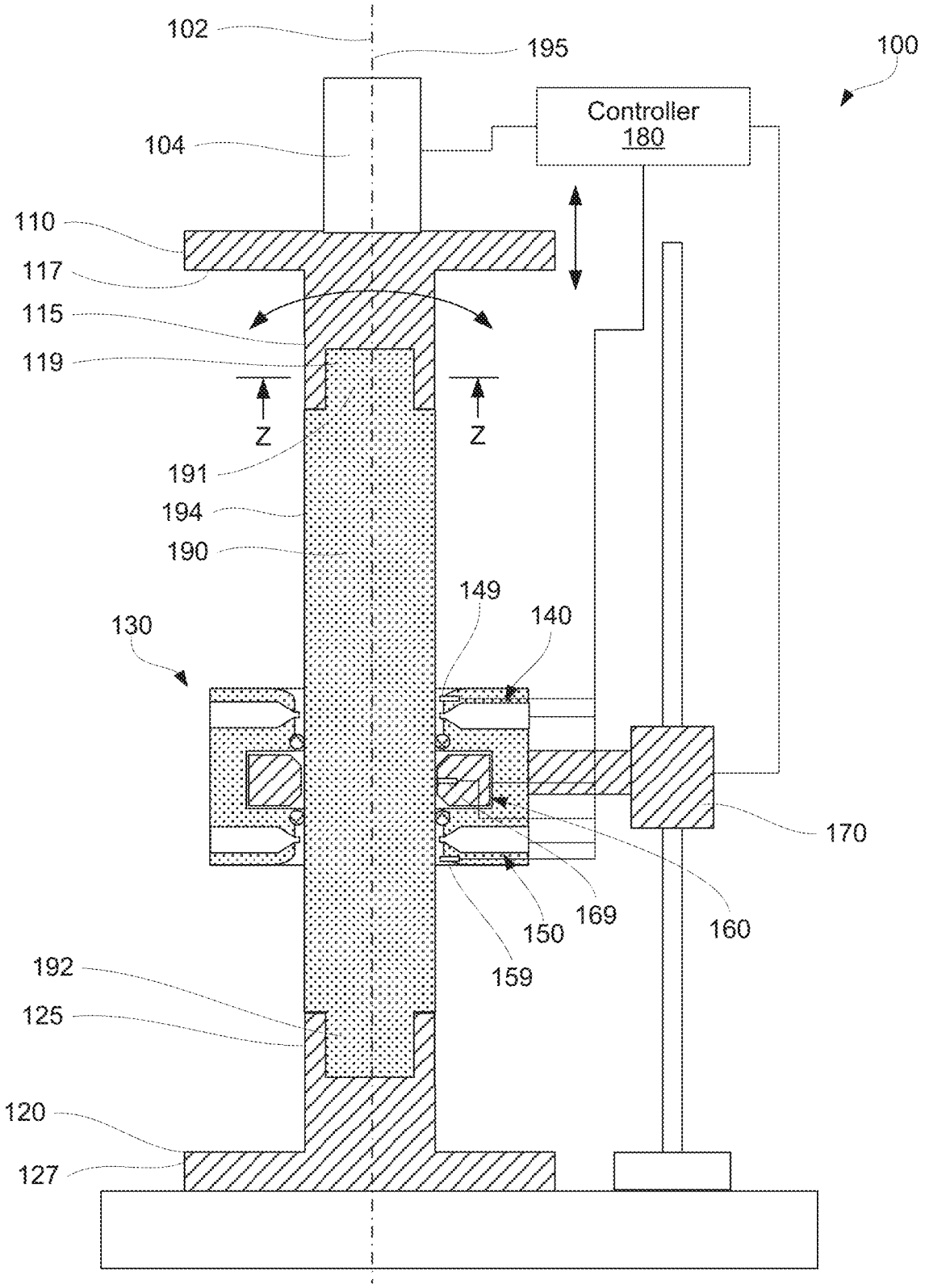
Figure 2B:
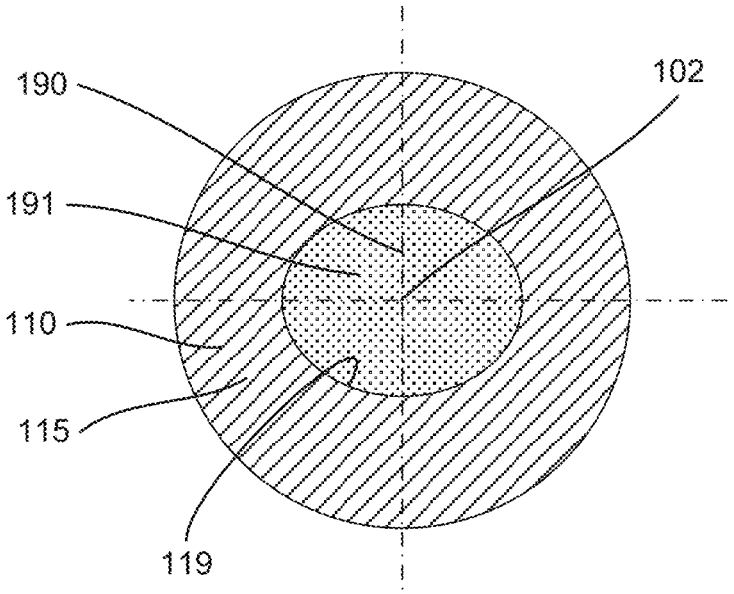
Figure 2C:
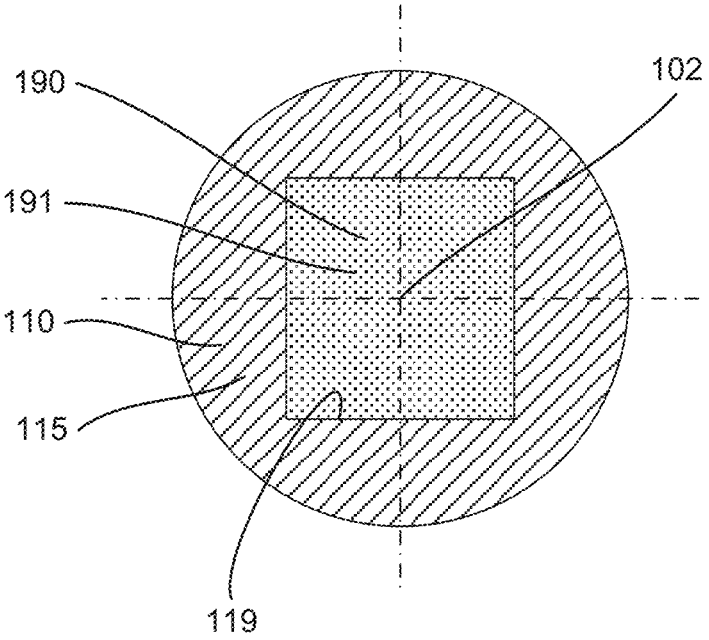
Figure 2D:
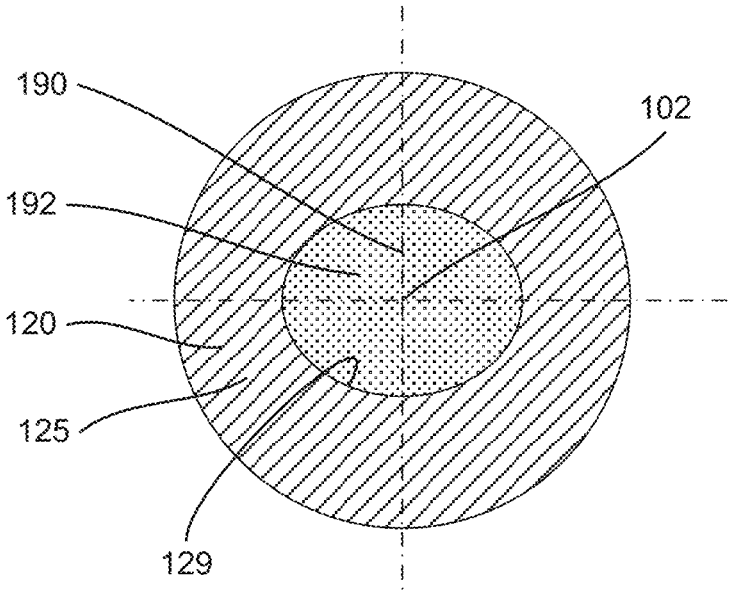
Figure 2E:
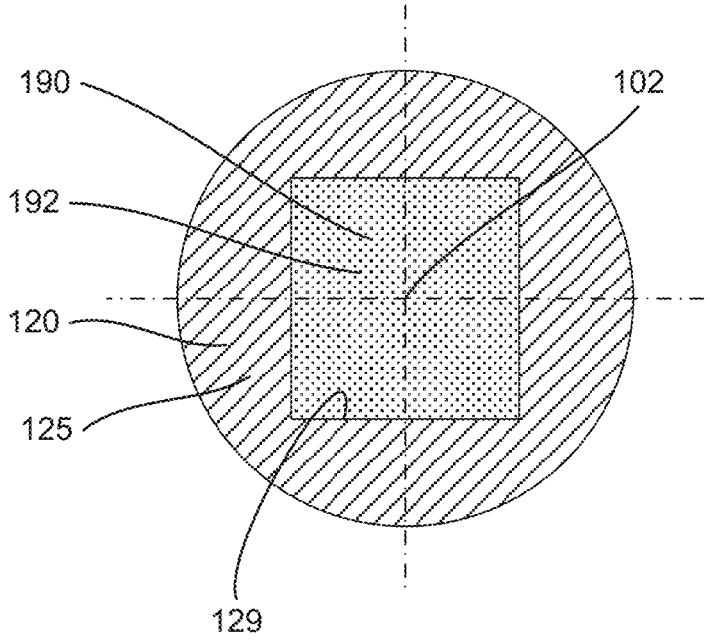
Figure 3A:
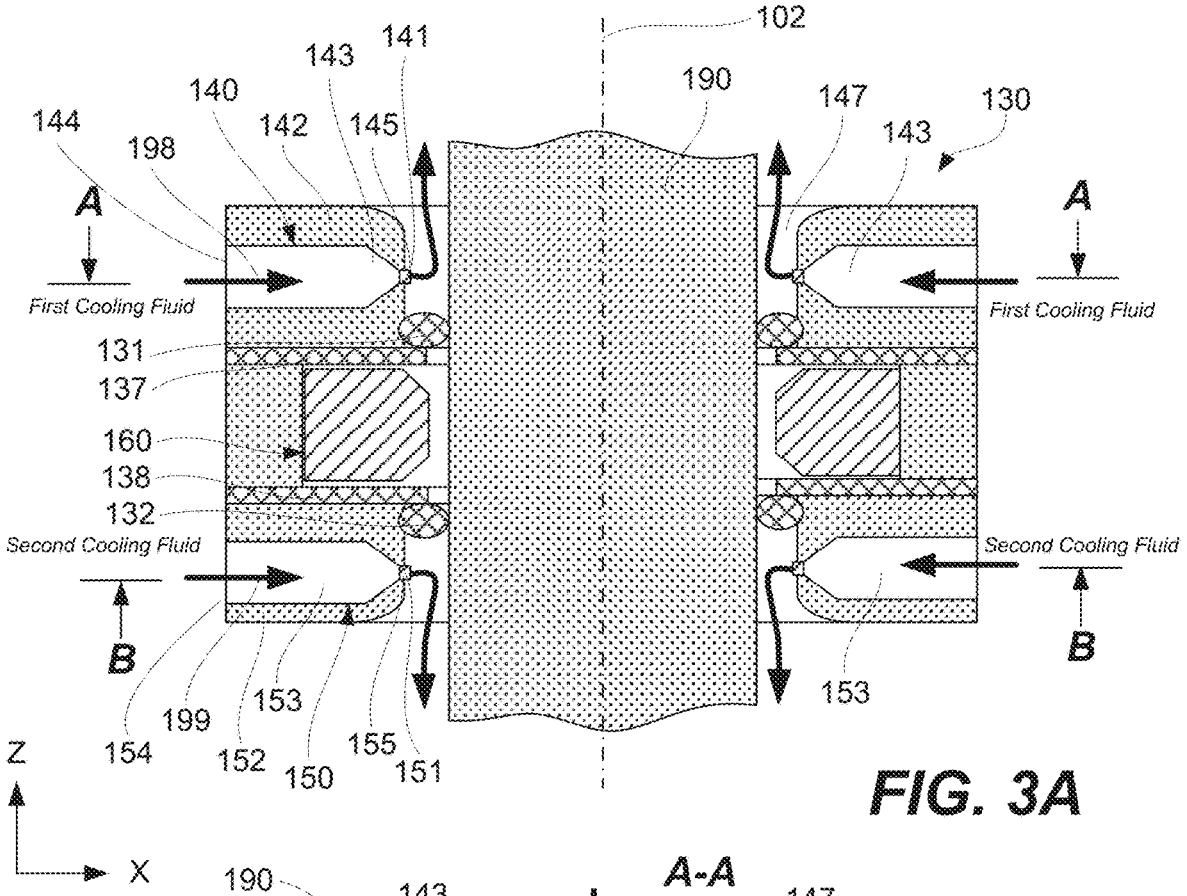
Figure 3B:
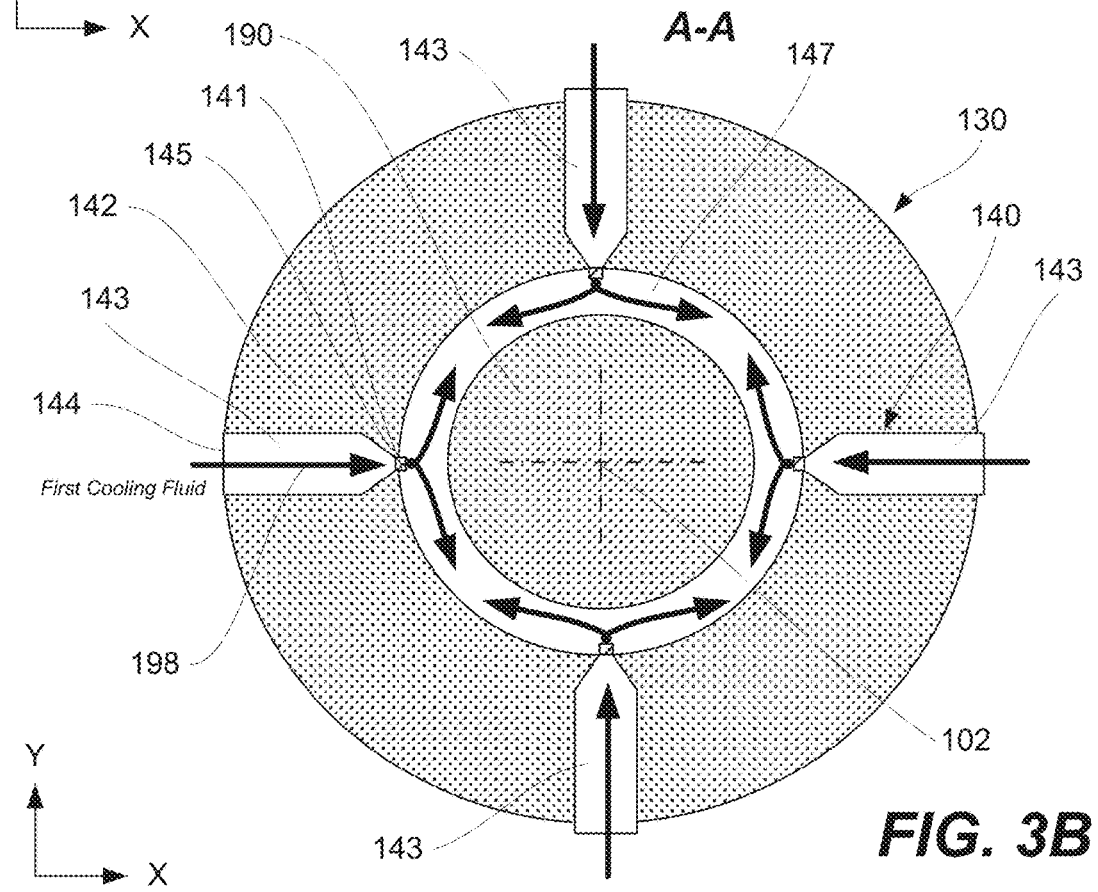
Figure 3C:
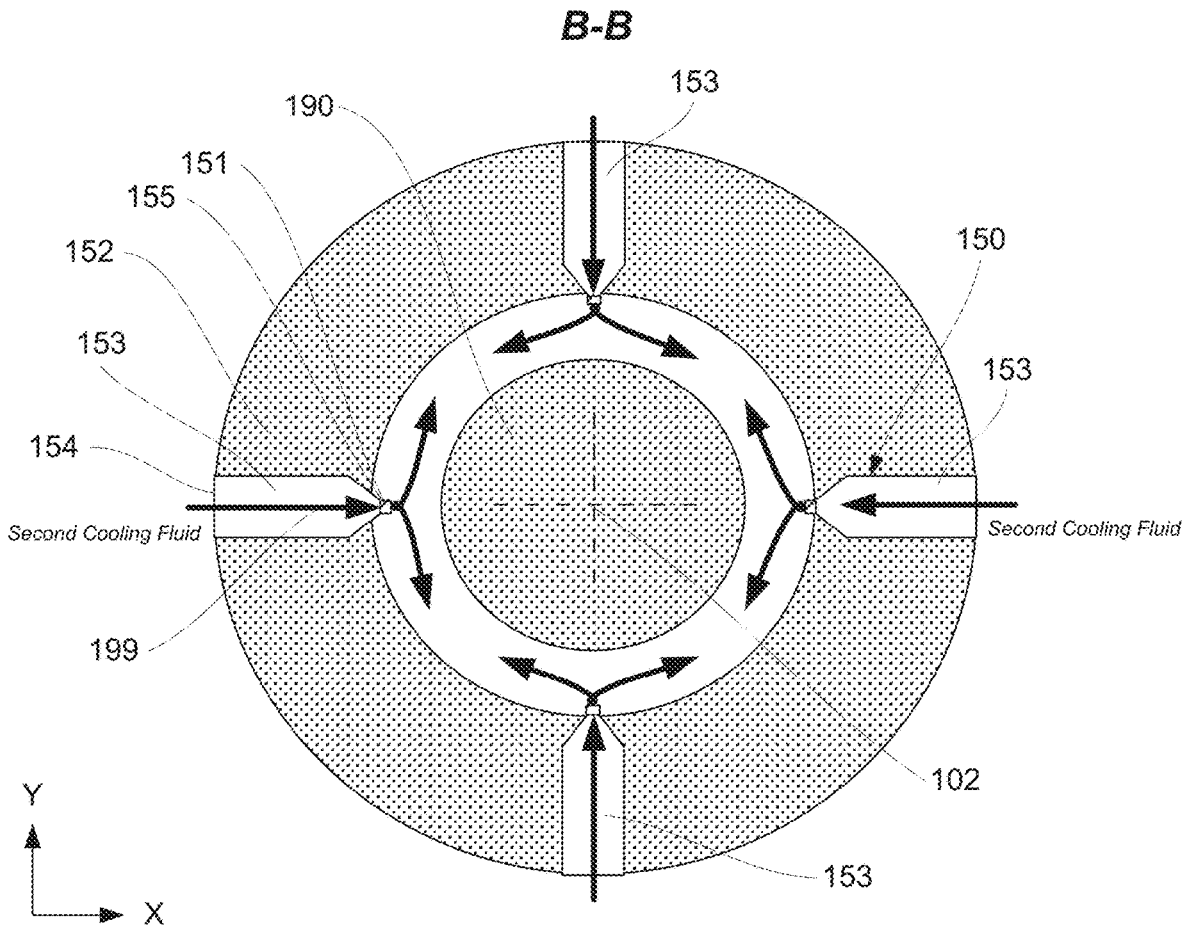
Figure 3D:
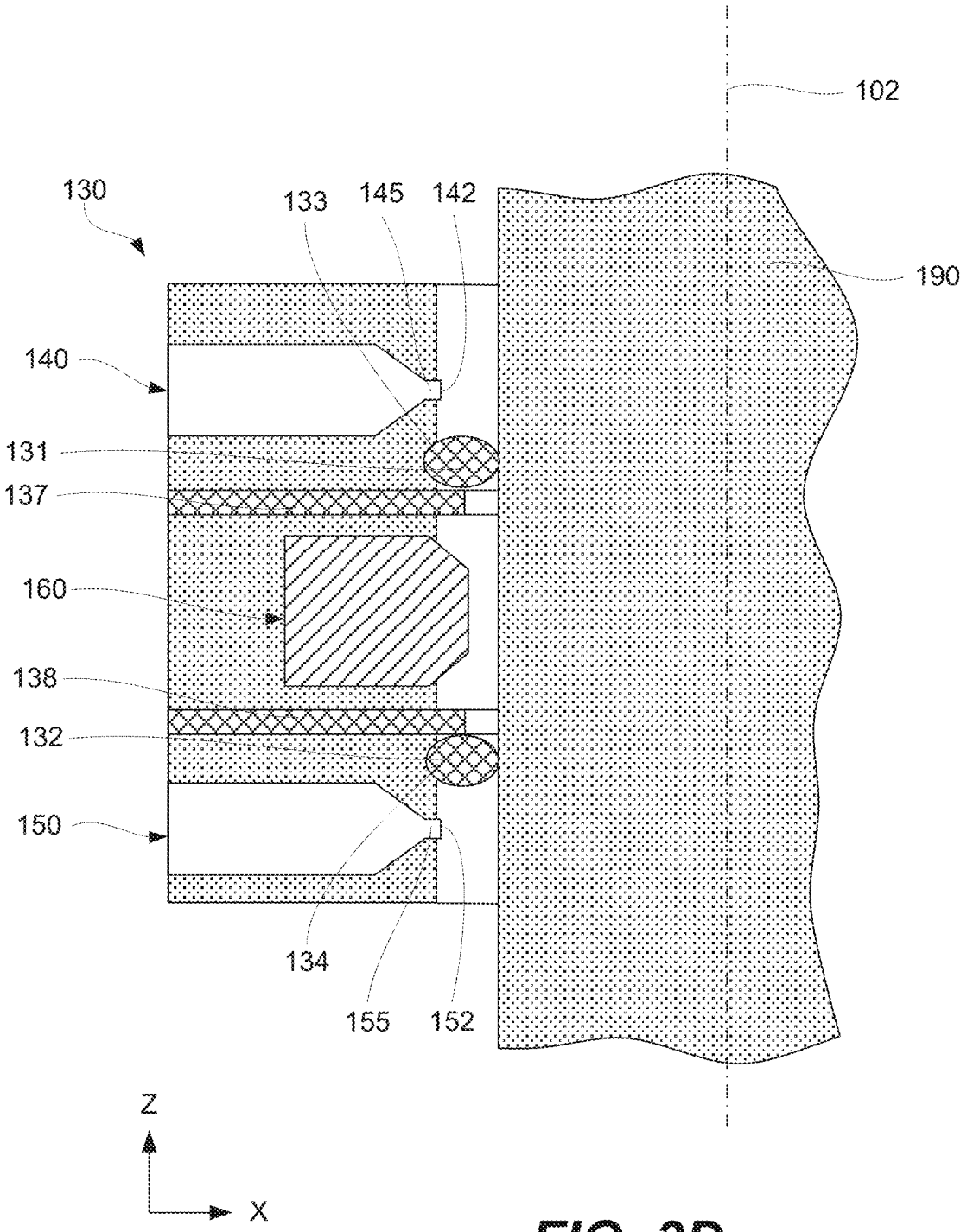
Figure 3E:
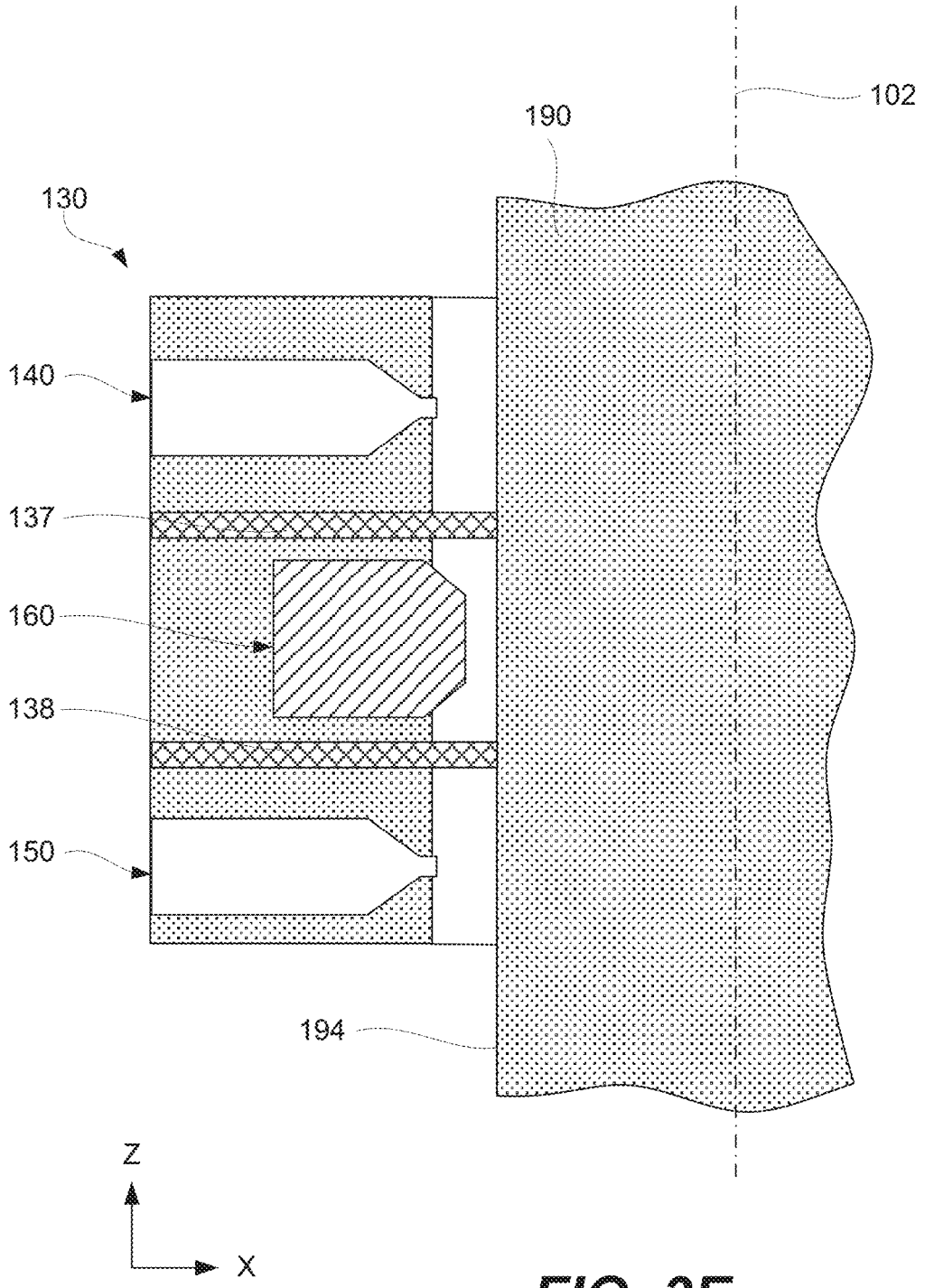
Figure 3F:
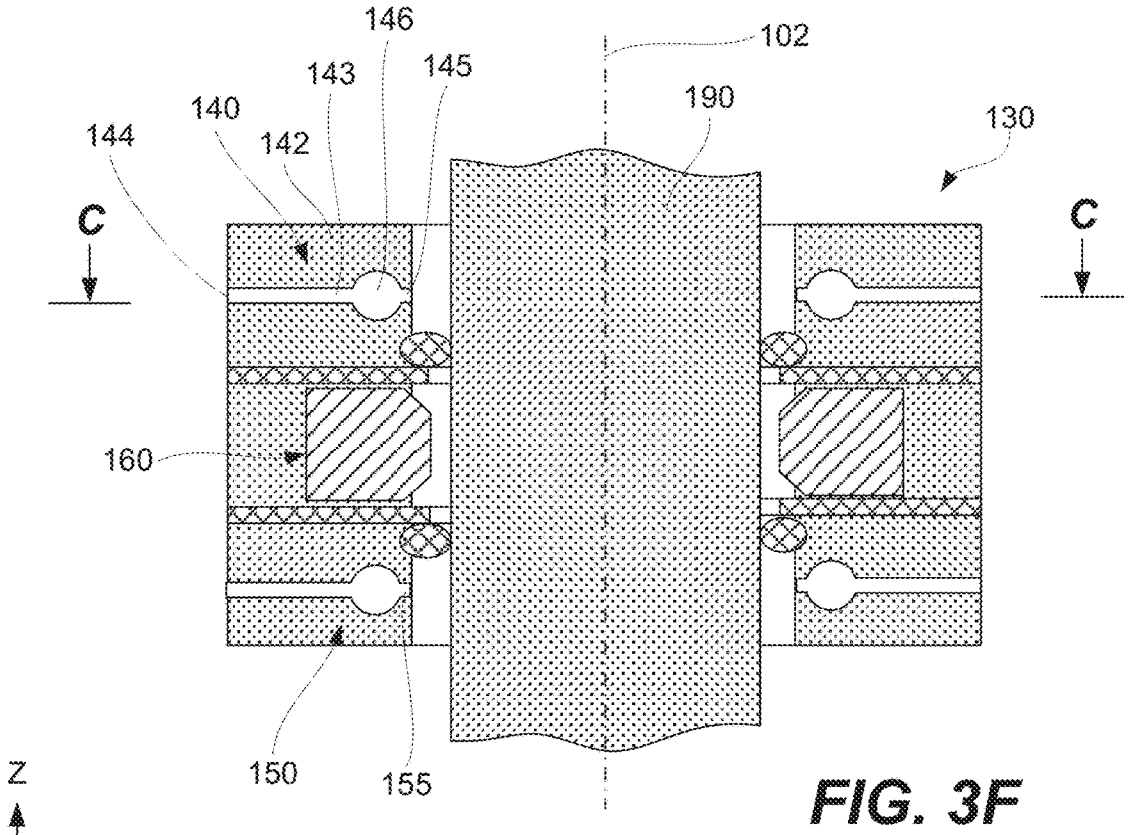
Figure 3G:
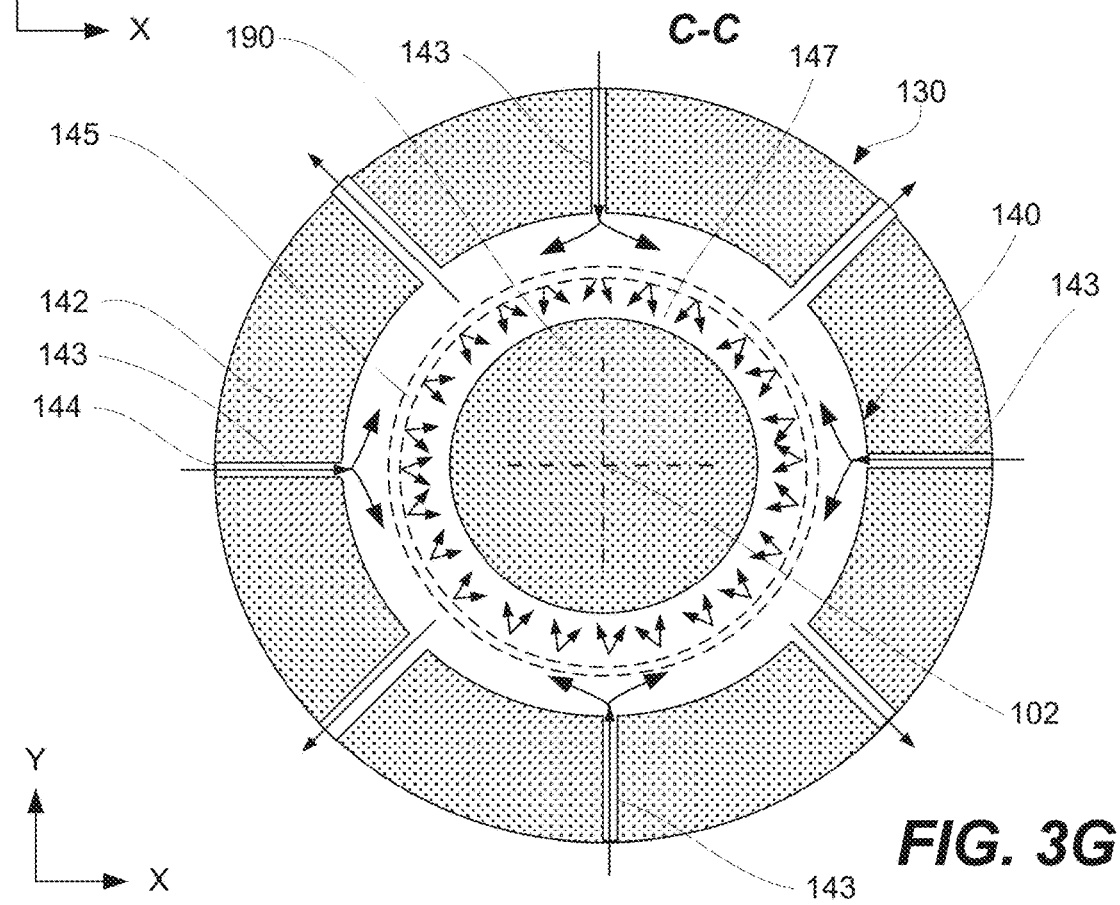
Figure 4B:
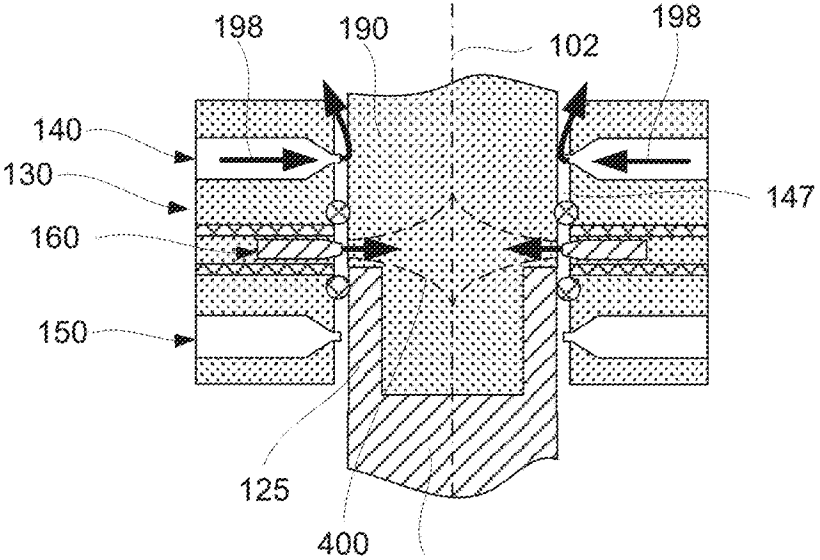
Figure 4A:
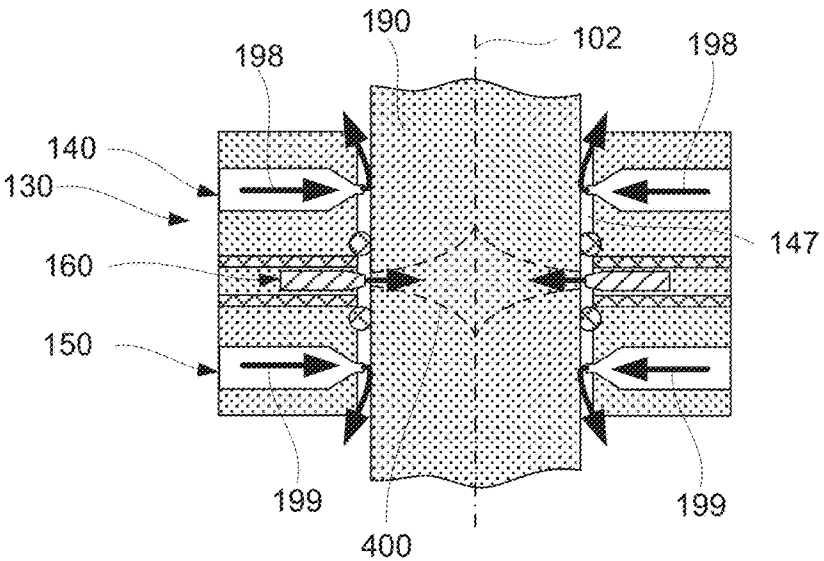
Figure 4C:
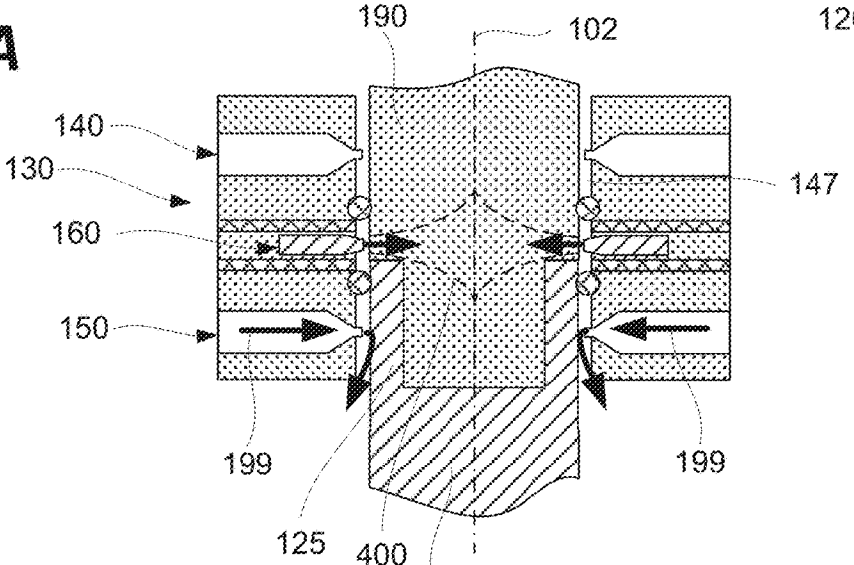
Figure 5:
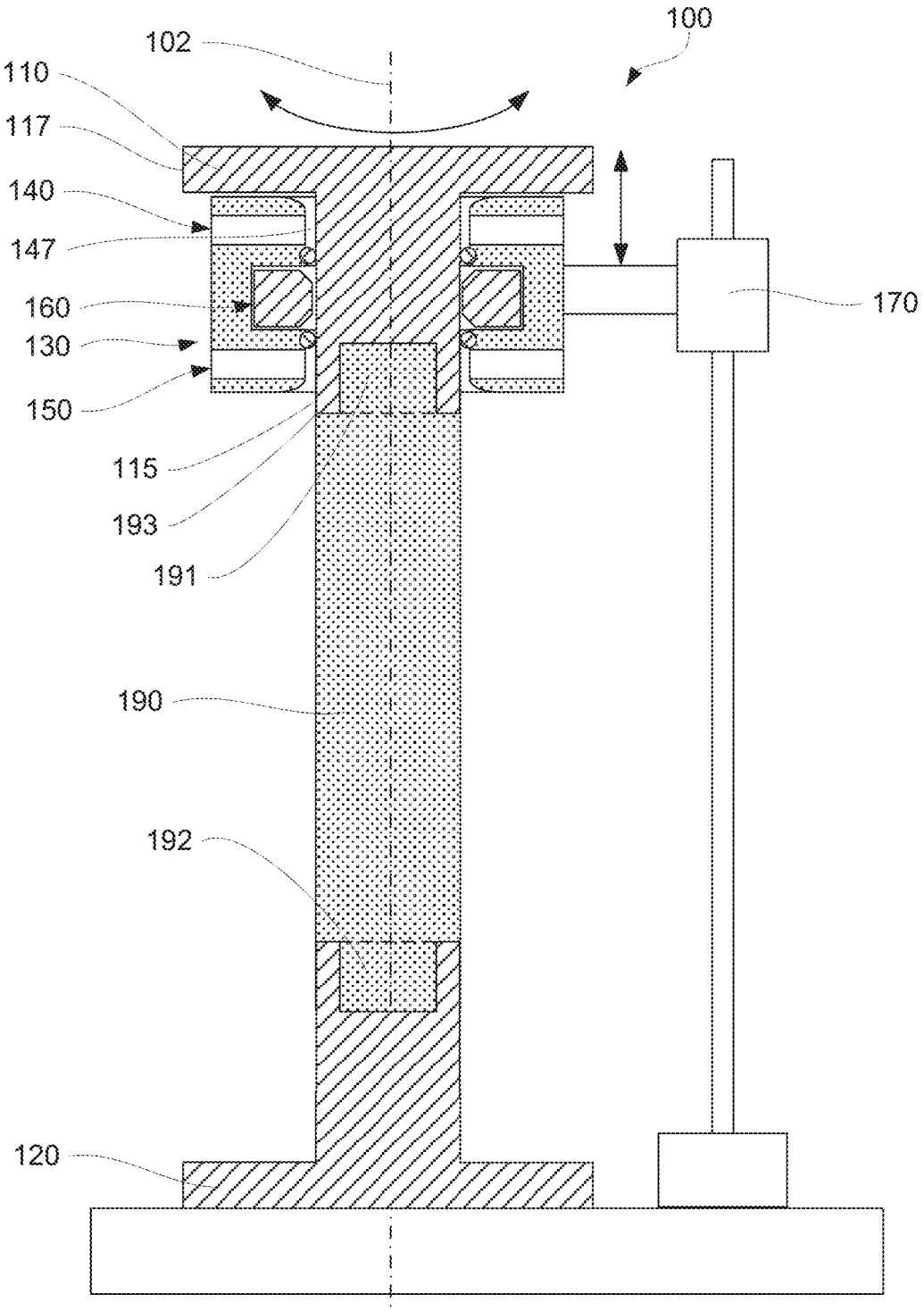
Figure 6:
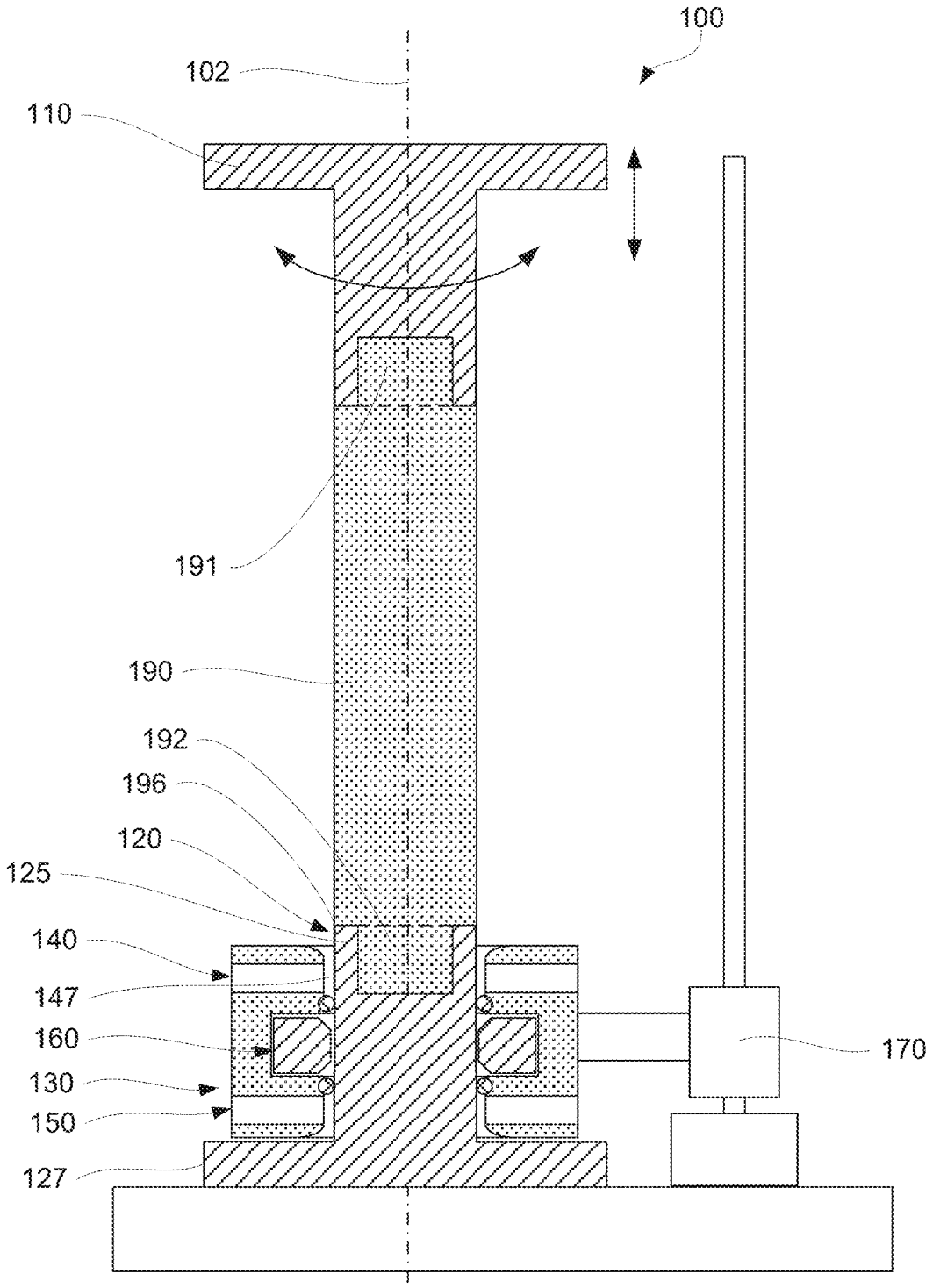
Figure 7:
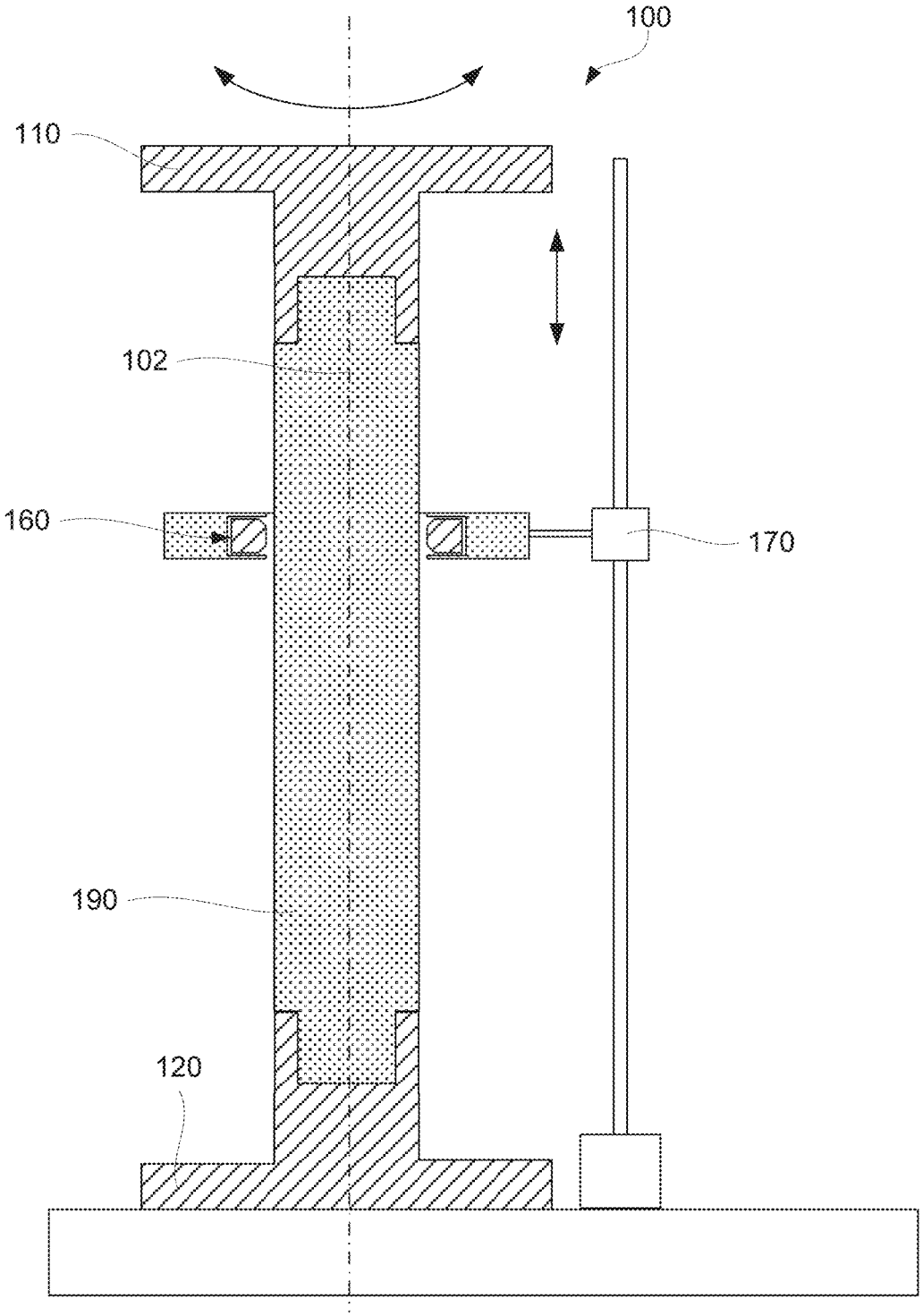
Figure 8A:
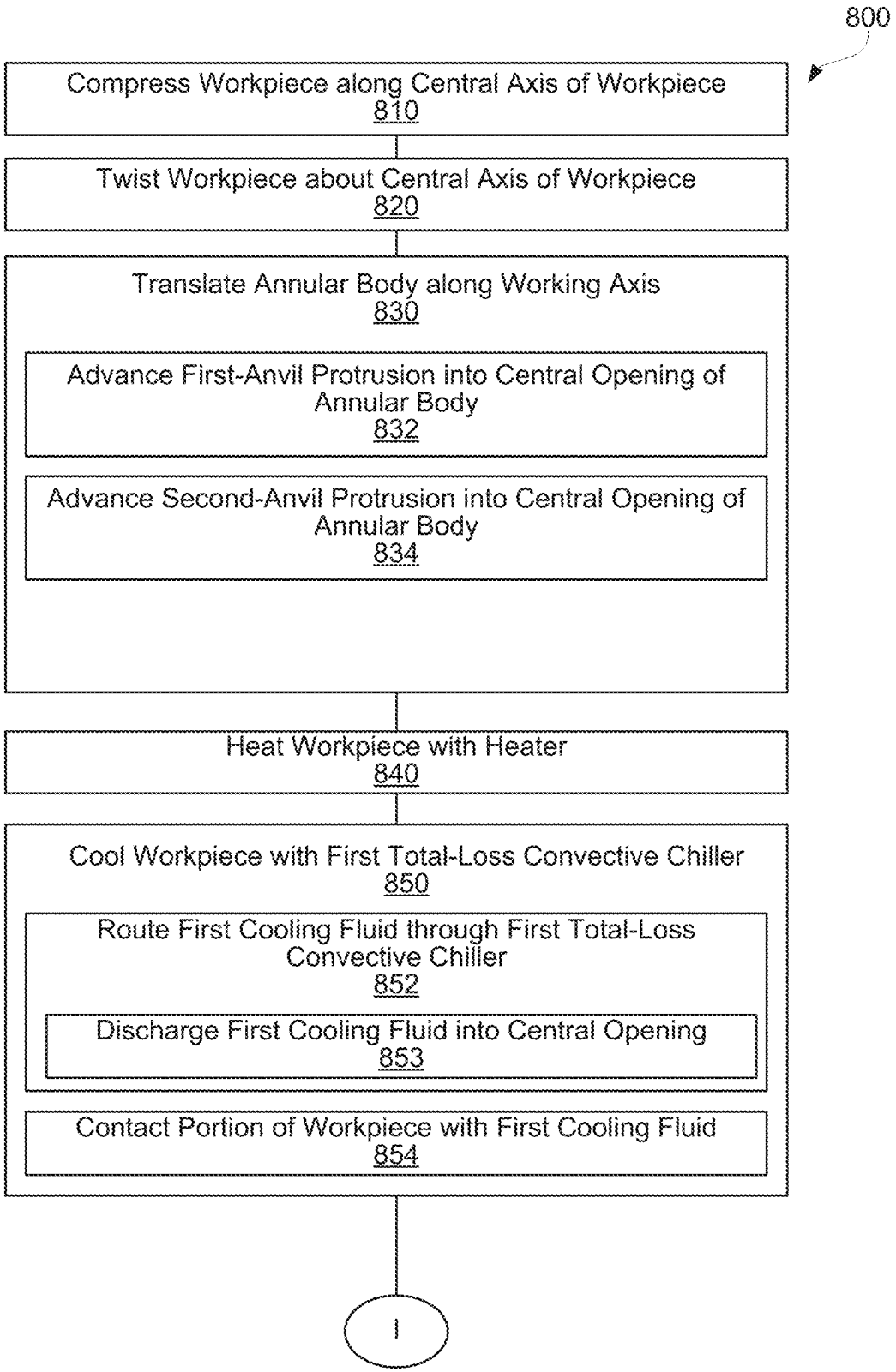
Figure 8B:
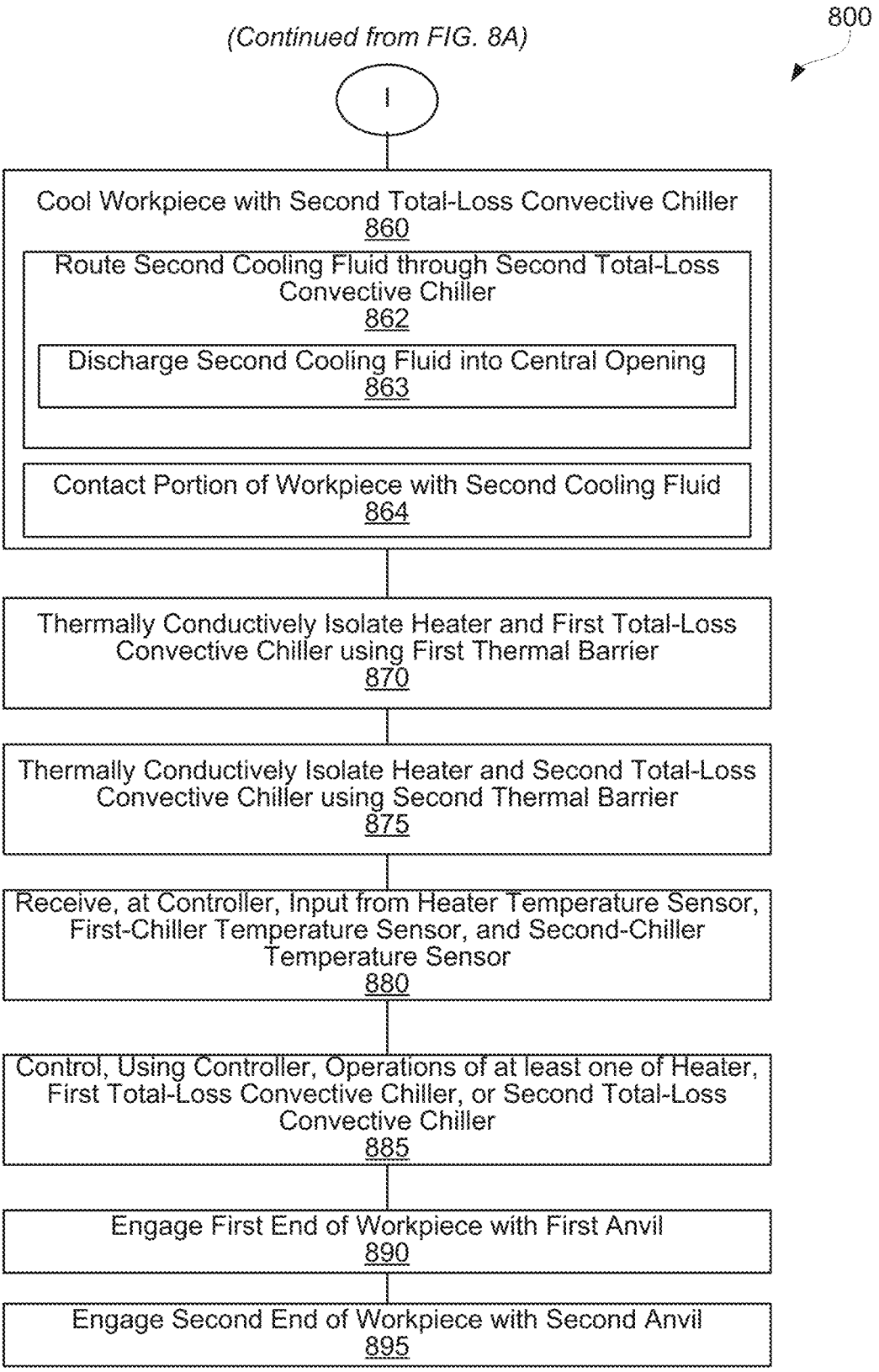
Figure 9:
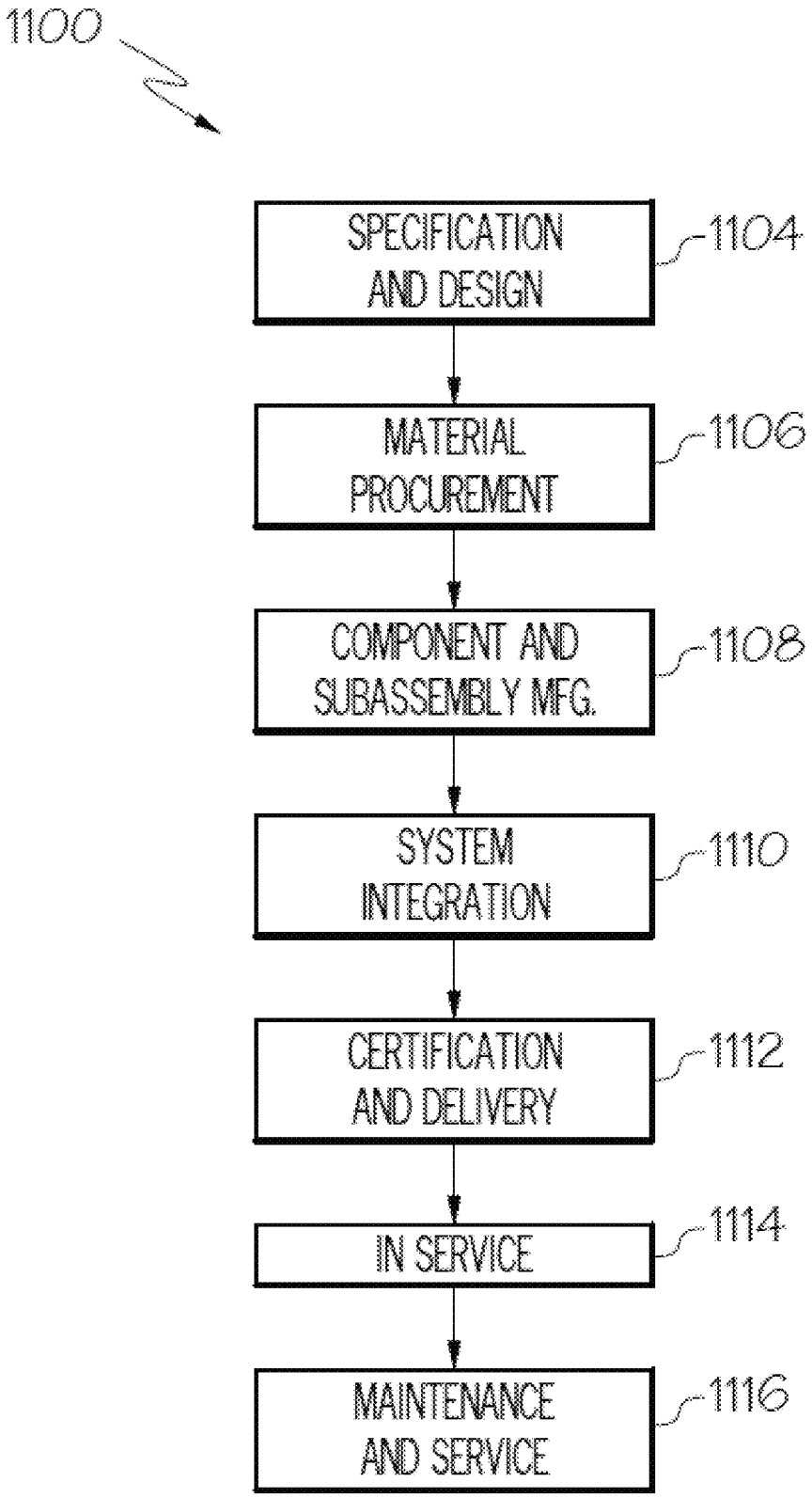
Figure 10:
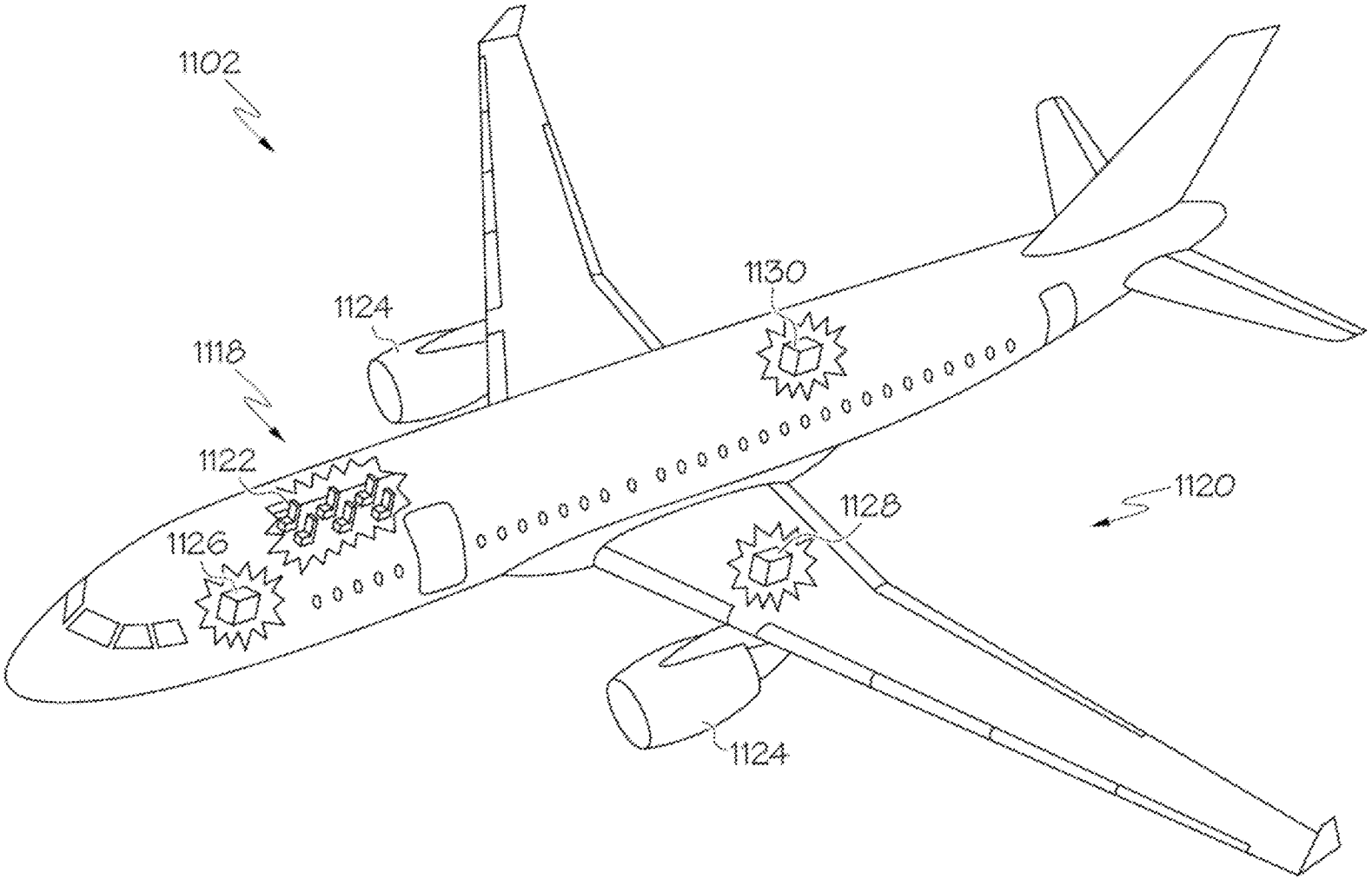

Having thus described one or more examples of the present disclosure in general terms, reference will now be made to the accompanying drawings, which are not necessarily drawn to scale, and wherein like reference characters designate the same or similar parts throughout the several views, and wherein:

FIGS. 1A and 1B, collectively, are a block diagram of an high-pressure-torsion apparatus, according to one or more examples of the present disclosure;

FIG. 2A is a schematic view of the high-pressure-torsion apparatus of FIGS. 1A and 1B, shown with a workpiece, according to one or more examples of the present disclosure;

FIGS. 2B and 2C are schematic, cross-sectional, top views of a first anvil of the high-pressure-torsion apparatus of FIGS. 1A and 1B, shown with a first end of the workpiece engaged by the first anvil, according to one or more examples of the present disclosure;

FIGS. 2D and 2E are schematic, cross-sectional, top views of a second anvil of the high-pressure-torsion apparatus of FIGS. 1A and 1B, shown with a second end of the workpiece engaged by the second anvil, according to one or more examples of the present disclosure;

FIG. 3A is a schematic, cross-sectional, side view of an annular body of the high-pressure-torsion apparatus of FIGS. 1A and 1B, shown with the workpiece protruding through a central opening in the annular body, according to one or more examples of the present disclosure;

FIG. 3B is a schematic, cross-sectional, top view of a first total-loss convective chiller of the high-pressure-torsion apparatus of FIGS. 1A and 1B, shown with the workpiece protruding the first total-loss convective chiller, according to one or more examples of the present disclosure;

FIG. 3C is a schematic, cross-sectional, top view of a second total-loss convective chiller of the high-pressure-torsion apparatus of FIGS. 1A and 1B, shown with the workpiece protruding the second total-loss convective chiller, according to one or more examples of the present disclosure;

FIG. 3D is a schematic, cross-sectional, side view of a portion of the annular body of the high-pressure-torsion apparatus of FIGS. 1A and 1B, showing positions of a first thermal seal, a second thermal seal, a first thermal barrier, and a second thermal barrier in the annular body and relative to the workpiece, according to one or more examples of the present disclosure;

FIG. 3E is a schematic, cross-sectional, side view of a portion of the annular body of the high-pressure-torsion apparatus of FIGS. 1A and 1B, showing positions of a first thermal barrier, and a second thermal barrier in the annular body and relative to the workpiece, according to one or more examples of the present disclosure;

FIG. 3F is a schematic, cross-sectional, side view of an annular body of the high-pressure-torsion apparatus of FIGS. 1A and 1B, shown with the workpiece protruding through a central opening in the annular body, according to one or more examples of the present disclosure;

FIG. 3G is a schematic, cross-sectional, top view of a first total-loss convective chiller of the high-pressure-torsion apparatus of FIGS. 1A and 1B, shown with the workpiece protruding the first total-loss convective chiller, according to one or more examples of the present disclosure;

FIGS. 4A-4C are schematic, cross-sectional, side views of the annular body of the high-pressure-torsion apparatus of FIGS. 1A and 1B, showing different operating modes of a first total-loss convective chiller and a second total-loss convective chiller, according to one or more examples of the present disclosure;

FIG. 5 is a schematic, cross-sectional, side view of the high-pressure-torsion apparatus of FIGS. 1A and 1B, showing a first-anvil protrusion protruding through the central opening in the annular body, according to one or more examples of the present disclosure;

FIG. 6 is a schematic, cross-sectional, side view of the high-pressure-torsion apparatus of FIGS. 1A and 1B, showing a second-anvil protrusion protruding through the central opening in the annular body, according to one or more examples of the present disclosure;

FIG. 7 is a schematic view of the high-pressure-torsion apparatus of FIGS. 1A and 1B, according to one or more examples of the present disclosure;

FIGS. 8A and 8B, collectively, are a block diagram of a method of modifying material properties of a workpiece, using the high-pressure-torsion apparatus of FIGS. 1A and 1B, according to one or more examples of the present disclosure;

FIG. 9 is a block diagram of aircraft production and service methodology; and FIG. 10 is a schematic illustration of an aircraft.

DETAILED DESCRIPTION

In FIGS. 1A and 1B, referred to above, solid lines, if any, connecting various elements and/or components may represent mechanical, electrical, fluid, optical, electromagnetic and other couplings and/or combinations thereof. As used herein, "coupled" means associated directly as well as indirectly. For example, a member A may be directly associated with a member B, or may be indirectly associated therewith, e.g., via another member C. It will be understood that not all relationships among the various disclosed elements are necessarily represented. Accordingly, couplings other than those depicted in the block diagrams may also exist. Dashed lines, if any, connecting blocks designating the various elements and/or components represent couplings similar in function and purpose to those represented by solid lines; however, couplings represented by the dashed lines may either be selectively provided or may relate to alternative examples of the present disclosure. Likewise, elements and/or components, if any, represented with dashed lines, indicate alternative examples of the present disclosure. One or more elements shown in solid and/or dashed lines may be omitted from a particular example without departing from the scope of the present disclosure. Environmental elements, if any, are represented with dotted lines. Virtual (imaginary) elements may also be shown for clarity. Those skilled in the art will appreciate that some of the features illustrated in FIGS. 1A and 1B may be combined in various ways without the need to include other features described in FIGS. 1A and 1B, other drawing figures, and/or the accompanying disclosure, even though such combination or combinations are not explicitly illustrated herein. Similarly, additional features not limited to the examples presented, may be combined with some or all of the features shown and described herein.

In FIGS. 8A and 8B, referred to above, the blocks may represent operations and/or portions thereof and lines connecting the various blocks do not imply any particular order or dependency of the operations or portions thereof. Blocks represented by dashed lines indicate alternative operations and/or portions thereof. Dashed lines, if any, connecting the various blocks represent alternative dependencies of the operations or portions thereof. It will be understood that not all dependencies among the various disclosed operations are necessarily represented. FIGS. 8A and 8B and the accompanying disclosure describing the operations of the method(s) set forth herein should not be interpreted as necessarily determining a sequence in which the operations are to be performed. Rather, although one illustrative order is indicated, it is to be understood that the sequence of the operations may be modified when appropriate. Accordingly, certain operations may be performed in a different order or simultaneously. Additionally, those skilled in the art will appreciate that not all operations described need be performed.

In the following description, numerous specific details are set forth to provide a thorough understanding of the disclosed concepts, which may be practiced without some or all of these particulars. In other instances, details of known devices and/or processes have been omitted to avoid unnecessarily obscuring the disclosure. While some concepts will be described in conjunction with specific examples, it will be understood that these examples are not intended to be limiting.

Unless otherwise indicated, the terms "first," "second," etc. are used herein merely as labels, and are not intended to impose ordinal, positional, or hierarchical requirements on the items to which these terms refer. Moreover, reference to, e.g., a "second" item does not require or preclude the existence of, e.g., a "first" or lower-numbered item, and/or, e.g., a "third" or higher-numbered item.

Reference herein to "one example" means that one or more feature, structure, or characteristic described in connection with the example is included in at least one implementation. The phrase "one example" in various places in the specification may or may not be referring to the same example.

As used herein, a system, apparatus, structure, article, element, component, or hardware "configured to" perform a specified function is indeed capable of performing the specified function without any alteration, rather than merely having potential to perform the specified function after further modification. In other words, the system, apparatus, structure, article, element, component, or hardware "configured to" perform a specified function is specifically selected, created, implemented, utilized, programmed, and/or designed for the purpose of performing the specified function. As used herein, "configured to" denotes existing characteristics of a system, apparatus, structure, article, element, component, or hardware which enable the system, apparatus, structure, article, element, component, or hardware to perform the specified function without further modification. For purposes of this disclosure, a system, apparatus, structure, article, element, component, or hardware described as being "configured to" perform a particular function may additionally or alternatively be described as being "adapted to" and/or as being "operative to" perform that function.

Illustrative, non-exhaustive examples, which may or may not be claimed, of the subject matter according the present disclosure are provided below.

Referring generally to FIGS. 1A and 1B and particularly to, e.g., FIGS. 2A, 4A-4C, 5, and 6, high-pressure-torsion apparatus 100 is disclosed. High-pressure-torsion apparatus 100 comprises working axis 102, first anvil 110, second anvil 120, and annular body 130. Second anvil 120 faces first anvil 110 and is spaced apart from first anvil 110 along working axis 102. First anvil 110 and second anvil 120 are translatable relative to each other along working axis 102. First anvil 110 and second anvil 120 are rotatable relative to each other about working axis 102. Annular body 130 comprises first total-loss convective chiller 140, second total-loss convective chiller 150, and heater 160. First total-loss convective chiller 140 is translatable between first anvil 110 and second anvil 120 along working axis 102. First total-loss convective chiller 140 is configured to be thermally convectively coupled with workpiece 190 and is configured to selectively cool workpiece 190. Second total-loss convective chiller 150 is translatable between first anvil 110 and second anvil 120 along working axis 102. Second total-loss convective chiller 150 is configured to be thermally convectively coupled with workpiece 190 and is configured to selectively cool workpiece 190. Heater 160 is positioned between first total-loss convective chiller 140 and second total-loss convective chiller 150 along working axis 102 and is translatable between first anvil 110 and second anvil 120 along working axis 102. Heater 160 is configured to selectively heat workpiece 190. The preceding subject matter of this paragraph characterizes example 1 of the present disclosure.

High-pressure-torsion apparatus 100 is configured to process workpiece 190 by beating a portion of workpiece 190 while applying compression and torque to workpiece 190 to this heated portion. By heating only a portion of workpiece 190, rather than heating and processing workpiece 190 in its entirety at the same time, all of high-pressure-torsion deformation is confined to the narrow heated layer only, imparting high strains needed for fine-grain development. This reduction in compression and torque translates into a design of high-pressure-torsion apparatus 100 that is less complex and costly. Furthermore, this reduction in compression and torque results in more precise control over processing parameters, such as temperature, compression load, torque, processing duration, and the like. As such, more specific and controlled material microstructures of workpiece 190. For example, ultrafine grained materials offer substantial advantage over coarser grained materials displaying higher strength and better ductility. Finally, high-pressure-torsion apparatus 100 is able to process workpiece 190 having much large dimensions, e.g., a length, extending along working axis 102 of high-pressure-torsion apparatus 100, than would otherwise be possible if workpiece 190 is processed in its entirety at the same time.

A stacked arrangement of first total-loss convective chiller 140, heater 160, and second total-loss convective chiller 150 allows controlling size and position of each processed portion of workpiece 190. A processed portion generally corresponds to a heated portion, defined, at least in part, by the position of heater 160 relative to workpiece 190 and the heating output of heater 160. While compression and torque are applied to workpiece 190 in its entirety, the modification of material properties primarily happens in the heated portion. More specifically, the modification happens in a processed portion, which has a temperature within a desired processing range, which is defined as operating temperature zone 400. Various examples of operating temperature zone 400 are shown in FIGS. 4A-4C.

When first total-loss convective chiller 140 and/or second total-loss convective chiller 150 are operational, the heated portion of workpiece 190 is adjacent to a first cooled portion and/or a second cooled portion. The first cooled portion is defined, at least in part, by the position of first total-loss convective chiller 140 relative to workpiece 190 and the cooling output of first total-loss convective chiller 140. The second cooled portion is defined, at least in part, by the position of second total-loss convective chiller 150 relative to workpiece 190 and the cooling output of second total-loss convective chiller 150. The first cooled portion and/or the second cooled portion are used to control the internal heat transfer within workpiece 190, thereby controlling some characteristics of the processed portion and the shape of operating temperature zone 400, shown in FIGS. 4A-4C First total-loss convective chiller 140, heater 160, and second total-loss convective chiller 150 are translatable along working axis 102 to process different portions of workpiece 190, along central axis 195 of workpiece 190 defining the length of workpiece 190. As a result, high-pressure-torsion apparatus 100 is configured to process workpiece 190 with a large length relative to conventional pressure-torsion techniques, e.g., when workpiece 190 is processed in its entirety.

First anvil 110 and second anvil 120 are designed to engage and retain workpiece 190 at respective ends, e.g., first end 191 and second end 192. When workpiece 190 is engaged by first anvil 110 and second anvil 120, first anvil 110 and second anvil 120 are also used to apply compression force and torque to workpiece 190. One or both first anvil 110 and second anvil 120 are movable. In general, first anvil 110 and second anvil 120 are movable along working axis 102 relative to each other to apply the compression force and to engage workpieces, having different lengths, First anvil 110 and second anvil 120 are also rotatable about working axis 102 relative to each other. In one or more examples, at least one of first anvil 110 and second anvil 120 is coupled to drive 104 as, for example, schematically shown in FIG. 2A.

Annular body 130 integrates first total-loss convective chiller 140, second total-loss convective chiller 150, and heater 160. More specifically, annular body 130 supports and maintains the orientation of first total-loss convective chiller 140, second total-loss convective chiller 150, and heater 160 relative to each other. Annular body 130 also controls the position of first total-loss convective chiller 140, second total-loss convective chiller 150, and heater 160 relative to workpiece 190, e.g., when first total-loss convective chiller 140, second total-loss convective chiller 150, and heater 160 are translated relative to workpiece 190 along working axis 102.

In one or more examples, during operation of high-pressure-torsion apparatus 100, each of first total-loss convective chiller 140 and second total-loss convective chiller 150 is thermally convectively coupled with workpiece 190 and selectively cool respective portions of workpiece 190, e.g., a first cooled portion and a second cooled portion. These first and second cooled portions are positioned on opposite sides, along working axis 102, of a portion, heated by heater 160, which is referred to as a heated portion. A combination of these cooled and heated portions define the shape of operating temperature zone 400, which is being processed.

In one or more examples, the thermal convective coupling between first total-loss convective chiller 140 and workpiece 190 is provided by first cooling fluid 198. First cooling fluid 198 is flown through first total-loss convective chiller 140 and discharged from first total-loss convective chiller 140 toward workpiece 190. When first cooling fluid 198 contacts workpiece 190, the temperature of first cooling fluid 198 is less than that of workpiece 190, at least at this contact location, resulting in cooling of the corresponding portion of workpiece 190. After contacting workpiece 190, first cooling fluid 198 is discharged into the environment.

Similarly, in one or more examples, the thermal convective coupling between second total-loss convective chiller 150 and workpiece 190 is provided by second cooling fluid 199. Second cooling fluid 199 is flown through second total-loss convective chiller 150 and discharged from second total-loss convective chiller 150 toward workpiece 190. When second cooling fluid 199 contacts workpiece 190, the temperature of second cooling fluid 199 is less than that of workpiece 190, at least at this location, resulting in cooling of the corresponding portion of workpiece 190. After contacting workpiece 190, second cooling fluid 199 is discharged into the environment.

Heater 160 is configured to selectively heat workpiece 190 either through direct contact with workpiece 190 or radiation. In case of radiation heating, heater 160 is spaced away from workpiece 190, resulting in a gap between heater 160 and workpiece 190. Various heater types, such as a resistive heater, an induction heater, and the like, are within the scope of the present disclosure. In one or more examples, heating output of heater 160 is controllably adjustable. As noted above, heating output determines the shape of operating temperature zone 400.

Referring generally to FIGS. 1A and 1B and particularly to, e.g., FIGS. 2A, 4A, 5, and 6, heater 160, first total-loss convective chiller 140, and second total-loss convective chiller 150 are translatable as a unit between first anvil 110 and second anvil 120 along working axis 102. The preceding subject matter of this paragraph characterizes example 2 of the present disclosure, wherein example 2 also includes the subject matter according to example 1, above.

When heater 160, first total-loss convective chiller 140, and second total-loss convective chiller 150 are translatable as a unit, the orientation of first total-loss convective chiller 140, heater 160, and second total-loss convective chiller 150, relative to each other, is maintained. Specifically, the distance between heater 160 and first total-loss convective chiller 140 remains the same. Likewise, the distance between heater 160 and second total-loss convective chiller 150 remains the same. These distances determine the shape of operating temperature zone 400 within workpiece 190 as is schematically shown, for example, in FIG. 4A. Therefore, when these distances are kept constant, the shape of operating temperature zone 400 also remains the same, which ensures processing consistency.

In one or more examples, annular body 130 is operable as a housing and/or structural support for heater 160, first total-loss convective chiller 140, and second total-loss convective chiller 150. Annular body 130 establishes a translatable unit, comprising heater 160, first total-loss convective chiller 140, and second total-loss convective chiller 150. In one or more examples, annular body 130 is connected to linear actuator 170, which translates annular body 130 and as, a result, also translates heater 160, first total-loss convective chiller 140, and second total-loss convective chiller 150 together along working axis 102.

Referring generally to FIGS. 1A and 1B and particularly to, e.g., FIGS. 4A-4C, heater 160 is configured to heat workpiece 190 when at least one of first total-loss convective chiller 140 or second total-loss convective chiller 150 is cooling workpiece 190. The preceding subject matter of this paragraph characterizes example 3 of the present disclosure, wherein example 3 also includes the subject matter according to example 1 or 2, above.

The shape of operating temperature zone 400, schematically shown in FIGS. 4A-4C, is controlled by heating action of heater 160 and cooling actions of first total-loss convective chiller 140 and second total-loss convective chiller 150. When heater 160 heats a portion of workpiece 190, heat spreads out from this portion, e.g., along central axis 195 of workpiece 190, due to the thermal conductivity of the material, forming workpiece 190. This internal heat transfer impacts the shape of operating temperature zone 400. To reduce or at least to control the effect of this internal heat transfer within workpiece 190 at least one of first total-loss convective chiller 140 or second total-loss convective chiller 150 is used for cooling one or more portions of workpiece 190 adjacent to the heated portion of workpiece 190.

In one or more examples, both first total-loss convective chiller 140 and second total-loss convective chiller 150 are used for selective cooling portions of workpiece 190 while heater 160 selectively heats a portion of workpiece 190. For example, at a particular processing stage, annular body 130 is positioned away from either first anvil 110 or second anvil 120, as schematically shown in FIG. 2A. At this stage, neither first anvil 110 nor second anvil 120 has a significant impact as a heat sink on the heated portion of workpiece 190. To control the internal heat transfer within workpiece 190 away from the heated portion in both directions along central axis 195, first total-loss convective chiller 140 and second total-loss convective chiller 150 are both used at the same time, as, for example, schematically shown in FIG. 4A. It should be noted that, in one or more examples, the cooling output of first total-loss convective chiller 140 is different from that of second total-loss convective chiller 150. In specific examples, when annular body 130 is translated from first anvil 110 to second anvil 120 and second total-loss convective chiller 150 is closer to second anvil 120 than first total-loss convective chiller 140, the cooling level of second total-loss convective chiller 150 is less than the cooling level of first total-loss convective chiller 140. In this example, second total-loss convective chiller 150 moves before heater 160 while first total-loss convective chiller 140 follows heater 160. As such, the portion of workpiece 190 facing second total-loss convective chiller 150 requires less cooling than the portion of workpiece 190 facing first total-loss convective chiller 140 to be at the same temperature.

Alternatively, in one or more examples, only one of first total-loss convective chiller 140 or second total-loss convective chiller 150 is used for cooling workpiece 190 while heater 160 heats workpiece 190. The other one of first total-loss convective chiller 140 or second total-loss convective chiller 150 is turned off and does not provide any cooling output. These examples are used when annular body 130 approaches or slides over first anvil 110 or second anvil 120. At these processing stages, first anvil 110 or second anvil 120 acts as a heat sink and cools workpiece 190. In other words, first anvil 110 or second anvil 120 already reduces the effect of the internal heat conduction within workpiece 190 and additional cooling from either first total-loss convective chiller 140 or second total-loss convective chiller 150 is not needed.

Referring generally to FIGS. 1A and 1B and particularly to, e.g., FIGS. 4B and 4C, heater 160 is configured to heat workpiece 190 when at least one of first total-loss convective chiller 140 or second total-loss convective chiller 150 is not cooling workpiece 190. The preceding subject matter of this paragraph characterizes example 4 of the present disclosure, wherein example 4 also includes the subject matter according to example 1 or 2, above.

The shape of operating temperature zone 400, schematically shown in FIG. 4A-4C, is controlled, at least in part, by heating action of heater 160 and cooling actions of first total-loss convective chiller 140 and second total-loss convective chiller 150. The shape is also affected by internal heat transfer within workpiece 190 (e.g., from a heated portion) and, in one or more examples, external heat transfer, such as between workpiece 190 and other components, engaging workpiece 190 (e.g., first anvil 110 and second anvil 120). To compensate for effects of external heat transfer, in one or more examples, first total-loss convective chiller 140 and/or second total-loss convective chiller 150 is turned off and does not cool workpiece 190.

Referring to a processing stage, shown in FIG. 4B, heater 160 heats a portion of workpiece 190 positioned near or even engaged by second anvil 120. At this stage, second anvil 120 operates as a heat sink, resulting in external heat transfer from workpiece 190 to second anvil 120. In this example, second total-loss convective chiller 150, which is positioned closer to second anvil 120 than heater 160 or which is already positioned around second anvil 120 as shown in FIG. 4B, is turned off and not cooling workpiece 190. Alternatively, referring to FIG. 4C, second total-loss convective chiller 150, which is still positioned closer to second anvil 120 than heater 160 or which is already positioned around second anvil 120, is turned on and now cooling second anvil 120. This feature is used to prevent damage to second anvil 120.

Operation of first total-loss convective chiller 140 and second total-loss convective chiller 150 is individually controllable. In one example, both first total-loss convective chiller 140 and second total-loss convective chiller 150 are operational and cooling respective portions of workpiece 190. In another example, one of first total-loss convective chiller 140 and second total-loss convective chiller 150 is operational while the other one of first total-loss convective chiller 140 and second total-loss convective chiller 150 is not operational. For example, first total-loss convective chiller 140 is not operational while second total-loss convective chiller 150 is operational, e.g., when annular body 130 approaches first anvil 110 and/or when first anvil 110 at least partially protrudes through annular body 130. Alternatively, first total-loss convective chiller 140 is operational while second total-loss convective chiller 150 is not operational, e.g., when annular body 130 approaches second anvil 120 and/or when second anvil 120 at least partially protrudes through annular body 130. Furthermore, in one or more examples, both first total-loss convective chiller 140 and second total-loss convective chiller 150 are not operational while heater 160 is operational. In one or more examples, the operation of each of first total-loss convective chiller 140 and second total-loss convective chiller 150 is controlled based on position of annular body 130 (e.g., relative to first anvil 110 or second anvil 120) and/or temperature feedback, as further described below. Furthermore, levels of cooling output of first total-loss convective chiller 140 and second total-loss convective chiller 150 are individually controllable.

Referring generally to FIGS. 1A and 1B and particularly to, e.g., FIGS. 3A, 3B, and 3C, first total-loss convective chiller 140 comprises first-chiller channel 143, having first-chiller-channel inlet 144 and first-chiller-channel outlet 145, spaced away from first-chiller-channel inlet 144. First-chiller-channel outlet 145 is configured to be directed at workpiece 190. Second total-loss convective chiller 150 comprises second-chiller channel 153, having second-chiller-channel inlet 154 and second-chiller-channel outlet 155, spaced away from second-chiller-channel inlet 154. Second-chiller-channel outlet 155 is configured to be directed at workpiece 190. The preceding subject matter of this paragraph characterizes example 5 of the present disclosure, wherein example 5 also includes the subject matter according to any one of examples 1 to 4, above.

Referring to FIGS. 3A and 3B, when first total-loss convective chiller 140 is operational, first cooling fluid 198 is supplied into first-chiller channel 143, through first-chiller-channel inlet 144. First cooling fluid 198 flows through first-chiller channel 143 and exits through first-chiller-channel outlet 145. At this point, the temperature of first cooling fluid 198 is less than that of workpiece 190, First cooling fluid 198 contacts a portion of workpiece 190, resulting in cooling of that portion.

Referring to FIGS. 3A and 3C, when second total-loss convective chiller 150 is operational, second cooling fluid 199 is supplied into second-chiller channel 153, through second-chiller-channel inlet 154. Second cooling fluid 199 flows through second-chiller channel 153 and exits second-chiller channel 153 through second-chiller-channel outlet 155. At this point, the temperature of second cooling fluid 199 is less than that of workpiece 190. Second cooling fluid 199 contacts a portion of workpiece 190, resulting in cooling of that portion.

Each of first-chiller-channel inlet 144 and second-chiller-channel inlet 154 is configured to connect to a cooling-fluid source, such as a line or conduit, a compressed-gas cylinder, a pump, and the like. In more specific examples, first-chiller-channel inlet 144 and second-chiller-channel inlet 154 are connected to the same fluid source. Alternatively, different cooling fluid sources are connected to first-chiller-channel inlet 144 and second-chiller-channel inlet 154. In more specific examples, first cooling fluid 198 is different from second cooling fluid 199. Alternatively, first cooling fluid 198 and second cooling fluid 199 have the same composition. In one or more examples, flow rates of first cooling fluid 198 and second cooling fluid 199 are independently controlled.

Referring to an example shown in FIGS. 3A and 3B, first total-loss convective chiller 140 comprises multiple instances of first-chiller channel 143, each comprising first-chiller-channel inlet 144 and first-chiller-channel outlet 145. In this example, these channels are evenly distributed around the perimeter of annular body 130 about working axis 102. Using multiple channels provides cooling uniformity around the perimeter of workpiece 190. Similarly, referring to FIGS. 3A and 3C, second total-loss convective chiller 150 comprises multiple instances of second-chiller channel 153. Each of multiple channels comprises second-chiller-channel inlet 154 and second-chiller-channel outlet 155. These multiple channels are evenly distributed about working axis 102.

Referring generally to FIGS. 1A and 1B and particularly to, e.g., FIGS. 3F and 3G, each one of first-chiller-channel outlet 145 and second-chiller-channel outlet 155 is annular and surrounds working axis 102. The preceding subject matter of this paragraph characterizes example 6 of the present disclosure, wherein example 6 also includes the subject matter according to example 5, above.

The annular configuration of first-chiller-channel outlet 145 and second-chiller-channel outlet 155 is used to provide uniform distribution of first cooling fluid 198 and second cooling fluid 199, respectively. Specifically, first-chiller-channel outlet 145, which is annular, distributes first cooling fluid 198 in a continuous manner around working axis 102. Similarly, second-chiller-channel outlet 155, which is annular, distributes second cooling fluid 199 in a continuous manner around working axis 102. Each of first-chiller-channel outlet 145 and second-chiller-channel outlet 155 is a continuous opening, surrounding workpiece 190.

Referring to FIGS. 3F and 3G, first total-loss convective chiller 140 comprises one or more instances of first-chiller channel 143 for delivering first cooling fluid 198 from first-chiller-channel inlet 144. Furthermore, first-chiller channel 143 comprises redistribution channel 146, which is annular and surrounds working axis 102. First cooling fluid 198 is delivered into redistribution channel 146 from first-chiller channel 143. However, before exiting first total-loss convective chiller 140 through first-chiller-channel outlet 145, first cooling fluid 198 flows in a circular direction around working axis 102 within redistribution channel 146. Therefore, when first cooling fluid 198 exits first-chiller-channel outlet 145, the flow of first cooling fluid 198 is continuous and uniform around working axis 102. In one or more examples, second total-loss convective chiller 150 is configured and operates in a similar manner.

Referring generally to FIGS. 1A and 1B and particularly to, e.g., FIGS. 3A and 3D, high-pressure-torsion apparatus 100 further comprises first thermal seal 131 and second thermal seal 132. First thermal seal 131 is located between heater 160 and first-chiller-channel outlet 145 of first total-loss convective chiller 140 along working axis 102 and is configured to be in contact with workpiece 190. Second thermal seal 132 is located between heater 160 and second-chiller-channel outlet 145 of second total-loss convective chiller 150 along working axis 102 and is configured to be in contact with workpiece 190. The preceding subject matter of this paragraph characterizes example 7 of the present disclosure, wherein example 7 also includes the subject matter according to example 5, above.

First thermal seal 131 prevents first cooling fluid 198, delivered from first-chiller-channel outlet 145 to workpiece 190, from entering the space between heater 160 and workpiece 190. It should be noted that heater 160 is positioned proximate to first-chiller-channel outlet 145. Furthermore, in one or more examples, both first-chiller-channel outlet 145 and heater 160 are offset by a gap from workpiece 190. First thermal seal 131 fluidically isolates the gap between first-chiller-channel outlet 145 and workpiece 190 from the gap between heater 160 and workpiece 190. Similarly, second thermal seal 132 prevents second cooling fluid 199, delivered from second-chiller-channel outlet 155 to workpiece 190, from entering the same space between heater 160 and workpiece 190. As a result, the efficiency of heater 160 is maintained even when first-chiller-channel outlet 145 and/or second-chiller-channel outlet 155 is operational.

In one or more examples, when workpiece 190 protrudes through annular body 130, each of first thermal seal 131 and second thermal seal 132 directly contacts and is sealed against both annular body 130 and workpiece 190. Each of first thermal seal 131 and second thermal seal 132 remains sealed again workpiece 190 even when first thermal seal 131 and second thermal seal 132 are translated together with annular body 130 along working axis 102 relative to workpiece 190. In one or more examples, first thermal seal 131 and second thermal seal 132 are formed from an elastic material, such as rubber.

Referring generally to FIGS. 1A and 1B and particularly to, e.g., FIGS. 3A and 31), each of first thermal seal 131 and second thermal seal 132 is annular and surrounds working axis 102. The preceding subject matter of this paragraph characterizes example 8 of the present disclosure, wherein example 8 also includes the subject matter according to example 7, above.

The annular configuration of first thermal seal 131 ensures that first cooling fluid 198 does not flow into the space between heater 160 and workpiece 190 at any location around the perimeter of workpiece 190. In other words, first thermal seal 131 contacts workpiece 190 around the entire perimeter of workpiece 190. Similarly, the annular configuration of second thermal seal 132 ensures that second cooling fluid 199 does not flow into the space between heater 160 and workpiece 190 at any location around the perimeter of workpiece 190. Second thermal seal 132 contacts workpiece 190 around the entire perimeter of workpiece 190.

In some example, the shape of each of first thermal seal 131 and second thermal seal 132 is the same as the shape of the perimeter of workpiece 190. This shape ensures the uniform contact and seal between first thermal seal 131 and second thermal seal 132 and workpiece 190. In one or more examples, the inner diameter of first thermal seal 131 and second thermal seal 132 is smaller than the outer diameter of workpiece 190 to ensure the interference fit, compressions of first thermal seal 131 and second thermal seal 132, and sealing of each of first thermal seal 131 and second thermal seal 132 relative to workpiece 190.

Referring generally to FIGS. 1A and 1B and particularly to, e.g., FIG. 3D, annular body 130 further comprises first annular groove 133 and second annular groove 134. First annular groove 133 is located between first-chiller-channel outlet 145 and heater 160 along working axis 102. Second annular groove 134 is located between heater 160 and second-chiller-channel outlet 155 along working axis 102. A portion of first thermal seal 131 is received within first annular groove 133, and a portion of second thermal seal 132 is received within second annular groove 134. The preceding subject matter of this paragraph characterizes example 9 of the present disclosure, wherein example 9 also includes the subject matter according to example 8, above.

First annular groove 133 supports first thermal seal 131 at least in a direction along working axis 102. Specifically, first annular groove 133 enables translating first thermal seal 131 relative to workpiece 190, along working axis 102 while maintaining the position of first thermal seal 131 relative to annular body 130. Furthermore, the sealing interface between first thermal seal 131 and workpiece 190 is preserved. As such, the location of the sealing interface relative to first total-loss convective chiller 140 and heater 160 is preserved. Likewise, second annular groove 134 enables translating second thermal seal 132 relative to workpiece 190 along working axis 102 while maintaining the position of second thermal seal 132 relative to annular body 130. The sealing interface between second thermal seal 132 and workpiece 190 is also preserved.

In some example, the shape of first annular groove 133 corresponds to the shape of at least a portion of first thermal seal 131 thereby maximizing the contact surface between annular body 130 and first thermal seal 131, within first annular groove 133. Similarly, the shape of second annular groove 134 corresponds to the shape of at least a portion of second thermal seal 132 located within second annular groove 134 thereby maximizing the contact surface between annular body 130 and second thermal seal 132. In one or more examples, first thermal seal 131 is adhered or otherwise attached to annular body 130 within first annular groove 133. Similarly, second thermal seal 132 is adhered or otherwise attached to annular body 130 within second annular groove 134.

Referring generally to FIGS. 1A and 1B and particularly to, e.g., FIGS. 3A and 3D, high-pressure-torsion apparatus 100 further comprises first thermal barrier 137 and second thermal barrier 138. First thermal barrier 137 thermally conductively isolates heater 160 and first total-loss convective chiller 140 and is configured to be spaced away from workpiece 190. Second thermal barrier 138 thermally conductively isolates heater 160 and second total-loss convective chiller 150 and is configured to be spaced away from workpiece 190. First thermal barrier 137 is in contact with first thermal seal 131. Second thermal barrier 138 is in contact with second thermal seal 132. The preceding subject matter of this paragraph characterizes example 10 of the present disclosure, wherein example 10 also includes the subject matter according to any one of examples 7 to 9, above.

First thermal barrier 137 reduces heat transfer between heater 160 and first total-loss convective chiller 140, when both are operational. As such, heating efficiency of heater 160 and cooling efficiency of first total-loss convective chiller 140 are improved. Similarly, second thermal barrier 138 reduces heat transfer between heater 160 and second total-loss convective chiller 150 thereby improving heating efficiency of heater 160 and cooling efficiency of second total-loss convective chiller 150.

In one or more examples, first thermal barrier 137 and/or second thermal barrier 138 are formed from a heat-insulating material, e.g., a material with a thermal conductivity of less than 1 W/m*K. Some examples of suitable material for first thermal barrier 137 and/or second thermal barrier 138 are fiberglass, mineral wool, cellulose, polymer foams (e.g., polyurethane foam, polystyrene foam), and the like. In one or more examples, the thickness of first thermal barrier 137 and/or second thermal barrier 138 is small, e.g., less than 10 millimeters or even less than 5 millimeters. The small thickness of first thermal barrier 137 and/or second thermal barrier 138 ensures that the distance between heater 160 and first total-loss convective chiller 140 as well as the distance between heater 160 and second total-loss convective chiller 150 are small thereby reducing the height of operating temperature zone 400.

Referring generally to FIGS. 1A and 1B and particularly to, e.g., FIGS. 3A-3C, each of first-chiller-channel inlet 144 of first total-loss convective chiller 140 and second-chiller-channel inlet 154 of second total-loss convective chiller 150 is configured to receive a compressed gas. The preceding subject matter of this paragraph characterizes example 11 of the present disclosure, wherein example 11 also includes the subject matter according to any one of examples 5 to 10, above.

The compressed gas is used to cool workpiece 190 when the compressed gas is discharged from first-chiller channel 143 and second-chiller channel 153 toward workpiece 190. Specifically, when the compressed gas is discharged from first-chiller-channel outlet 145, the compressed gas expands in the space between first total-loss convective chiller 140 and workpiece 190. This expansion causes the gas temperature to drop. The cooled gas then contacts a portion of workpiece 190, resulting in efficient cooling of this portion. Similarly, when the compressed gas is discharged from second-chiller-channel outlet 155, the compressed gas expands and cools in the space between second total-loss convective chiller 150 and workpiece 190. The cooled gas contacts a portion of workpiece 190, resulting in efficient cooling that portion.

Some examples of the compressed gas, operable as first cooling fluid 198, used in first total-loss convective chiller 140, or second cooling fluid 199, used in second total-loss convective chiller 150, are compressed air and nitrogen. Once these gases are used for cooling workpiece 190, the gases are released to the environment. In one or more examples, different compressed gases are used in first total-loss convective chiller 140 and second total-loss convective chiller 150.

Referring generally to FIGS. 1A and 1B and particularly to, e.g., FIG. 3D, first-chiller-channel outlet 145 of first total-loss convective chiller 140 comprises first flow restrictor 142. Second-chiller-channel outlet 155 of second total-loss convective chiller 150 comprises second flow restrictor 152. The preceding subject matter of this paragraph characterizes example 12 of the present disclosure, wherein example 12 also includes the subject matter according to example 11, above.

First flow restrictor 142 is used to restrict the flow of first cooling fluid 198 (e.g., a compressed gas) when first cooling fluid 198 is discharged from first-chiller channel 143. This flow restriction, in turn, is used to maintain different pressure levels of first cooling fluid 198, before and after the discharge, which in turn results in expansion and cooling of first cooling fluid 198 during the discharge. Similarly, second flow restrictor 152 is used to restrict the flow of second cooling fluid 199 (e.g., a compressed gas) when second cooling fluid 199 is discharged from second-chiller channel 153. This flow restriction, in turn, is used to maintain different pressure levels of second cooling fluid 199 before and after the discharge, resulting in expansion and cooling of second cooling fluid 199 during the discharge.

In one or more examples, first flow restrictor 142 and second flow restrictor 152 are integrated into first-chiller channel 143 and second-chiller channel 153, respectively. In more specific examples, first flow restrictor 142 is a narrowed portion of first-chiller channel 143 positioned at first-chiller-channel outlet 145. Similarly, second flow restrictor 152 is a narrowed portion of second-chiller channel 153 positioned at second-chiller-channel outlet 155. Alternatively, first flow restrictor 142 and second flow restrictor 152 are removable and replaceable. For examples, one or both first flow restrictor 142 and second flow restrictor 152 are replaced with other flow restrictors that, for example, have different size orifices and, as a result, different cooling levels.

Referring generally to FIGS. 1A and 1B and particularly to, e.g., FIGS. 3A-3C, first-chiller-channel outlet 145 of first total-loss convective chiller 140 comprises first expansion valve 141. Second-chiller-channel outlet 155 of second total-loss convective chiller 150 comprises second expansion valve 151. The preceding subject matter of this paragraph characterizes example 13 of the present disclosure, wherein example 13 also includes the subject matter according to example 11 or 12, above.

First expansion valve 141 is used to controllably restrict the flow of first cooling fluid 198. This flow control results in different pressure levels of first cooling fluid 198 before and after discharge from first-chiller channel 143 and different cooling power of first total-loss convective chiller 140, when first cooling fluid 198 is discharges from first-chiller channel 143 due to the expansion. Overall, the flow rate of first cooling fluid 198 and the pressure differential (before and after the expansion of first cooling fluid 198) is at least partially controlled by first expansion valve 141. Similarly, second expansion valve 151 is used to controllably restrict the flow of second cooling fluid 199. This flow control results in different pressure levels of second cooling fluid 199 before and after discharge from second-chiller channel 153 and different cooling power of second total-loss convective chiller 150. Overall, the flow rate of second cooling fluid 199 and the pressure differential (before and after the expansion of second cooling fluid 199) is at least partially controlled by second expansion valve 151.

In one or more examples, first expansion valve 141 and second expansion valve 151 are independently controlled, resulting in different cooling powers of first total-loss convective chiller 140 and second total-loss convective chiller 150. For examples, first expansion valve 141 and second expansion valve 151 are connected to controller 180, which also controls other processing aspects. Each of first expansion valve 141 and second expansion valve 151 is operable to be fully open, fully close, or have multiple different intermediate positions.

Referring generally to FIGS. 1A and 1B and particularly to, e.g., FIG. 3E, high-pressure-torsion apparatus 100 further comprises first thermal barrier 137 and second thermal barrier 138. First thermal barrier 137 thermally conductively isolates heater 160 and first total-loss convective chiller 140 and is configured to be in contact with workpiece 190. Second thermal barrier 138 thermally conductively isolates heater 160 and second total-loss convective chiller 150 and is configured to be in contact with workpiece 190. The preceding subject matter of this paragraph characterizes example 14 of the present disclosure, wherein example 14 also includes the subject matter according to any one of examples 1 to 9, above.

First thermal barrier 137 reduces heat transfer between heater 160 and first total-loss convective chiller 140 thereby improving heating efficiency of heater 160 and cooling efficiency of first total-loss convective chiller 140. Furthermore, when first thermal barrier 137 extends to and contacts workpiece 190 as, for example, is shown in FIG. 3E, first thermal barrier 137 also prevents flow of first cooling fluid 198 into the space between heater 160 and workpiece 190. In other words, first thermal barrier 137 is also operable as a seal. Similarly, second thermal barrier 138 reduces heat transfer between heater 160 and second total-loss convective chiller 150 thereby improving heating efficiency of heater 160 and cooling efficiency of second total-loss convective chiller 150. When second thermal barrier 138 extends to and contacts workpiece 190 as, for example, is shown in FIG. 3E, second thermal barrier 138 also prevents flow of second cooling fluid 199 into the space between heater 160 and workpiece 190. In other words, second thermal barrier 138 is also operable as a seal.

In one or more examples, first thermal barrier 137 and/or second thermal barrier 138 are formed from a heat-insulating material, e.g., a material with a thermal conductivity of less than of less than 1 W/m*K. Some examples of suitable material are fiberglass, mineral wool, cellulose, polymer foams (e.g., polyurethane foam, polystyrene foam). In one or more examples, the thickness of first thermal barrier 137 and/or second thermal barrier 138 is small, e.g., less than 10 millimeters or even less than 5 millimeters to ensure that the distance between heater 160 and first total-loss convective chiller 140 as well as the distance between heater 160 and second total-loss convective chiller 150 are small. The proximity of first total-loss convective chiller 140 and second total-loss convective chiller 150 to heater 160 ensures that the height (axial dimension) of operating temperature zone 400 is small.

In one or more examples, the inner diameter of first thermal barrier 137 and second thermal barrier 138 is less than the diameter of workpiece 190 to ensure the interference fit and sealing between first thermal barrier 137 and workpiece 190 and, separately, between second thermal barrier 138 and workpiece 190. When first thermal barrier 137 extends to and contacts workpiece 190, no separate seal is needed between annular body 130 and workpiece 190, at least in around first total-loss convective chiller 140. Similarly, when second thermal barrier 138 extends to and contacts workpiece 190, no separate seal is needed between annular body 130 and workpiece 190, at least in around second total-loss convective chiller 150.

Referring generally to FIGS. 1A and 1B and particularly to, e.g., FIGS. 3A and 3B, annular body 130 has central opening 147, sized to receive workpiece 190 with a clearance fit. The preceding subject matter of this paragraph characterizes example 15 of the present disclosure, wherein example 15 also includes the subject matter according to any one of examples 1 to 14, above.

Central opening 147 enables workpiece 190 to protrude through annular body 130 such that annular body 130 surrounds workpiece 190. As such, various components of annular body 130 have access to the entire perimeter of workpiece 190 and able to process the entire perimeter. Specifically, first total-loss convective chiller 140 is operable to selectively cool a portion of workpiece 190 around the entire perimeter of workpiece 190. Likewise, heater 160 is operable to selectively heat another portion of workpiece 190 around the entire perimeter of workpiece 190. Finally, second total-loss convective chiller 150 is operable to selective cool yet another portion of workpiece 190 around the entire perimeter of workpiece 190.

In one or more examples, annular body 130 and workpiece 190 have clearance fit to allow for annular body 130 to freely move relative to workpiece 190, especially when workpiece 190 radially expands during heating. More specifically, the gap between annular body 130 and workpiece 190, in the radial direction, is between 1 millimeter and 10 millimeters wide, around the entire perimeter or, more specifically, between 2 millimeters and 8 millimeters. In specific examples, the gap is uniform around the entire perimeter.

Referring generally to FIGS. 1A and 1B and particularly to, e.g., FIG. 5, first anvil 110 comprises first-anvil base 117 and first-anvil protrusion 115, extending from first-anvil base 117 toward second anvil 120 along working axis 102. First-anvil protrusion 115 has a diameter that is smaller than that of first-anvil base 117 and that is smaller than that of central opening 147 of annular body 130. The preceding subject matter of this paragraph characterizes example 16 of the present disclosure, wherein example 16 also includes the subject matter according to example 15, above.

When the diameter of first-anvil protrusion 115 is smaller than the diameter of central opening 147 of annular body 130, first-anvil protrusion 115 is able to protrude into central opening 147 as, for example, schematically shown in FIG. 5. This feature enables maximizing the processed length of workpiece 190. Specifically, in one or more examples, the entire portion of workpiece 190, extending between first anvil 110 and second anvil 120, is accessible to each processing component of annular body 130, such as first total-loss convective chiller 140, heater 160, and second total-loss convective chiller 150.

In one or more examples, the diameter of first-anvil protrusion 115 is the same as the diameter of the portion of workpiece 190, extending between first anvil 110 and second anvil 120 and not engaged by first anvil 110 and second anvil 120. This ensures continuity of the seal when first total-loss convective chiller 140 faces first-anvil protrusion 115, e.g., past external interface point 193 between first-anvil protrusion 115 and workpiece 190.

Referring generally to FIGS. 1A and 1B and particularly to, e.g., FIG. 5, first-anvil protrusion 115 has a maximum dimension along working axis 102 that is equal to or greater than that of annular body 130. The preceding subject matter of this paragraph characterizes example 17 of the present disclosure, wherein example 17 also includes the subject matter according to example 16, above.

When the maximum dimension of first-anvil protrusion 115 along working axis 102 is equal to or greater than that of annular body 130, first-anvil protrusion 115 is able to protrude through annular body 130 entirely. As such, all three operating components of annular body 130 pass external interface point 193 between first-anvil protrusion 115 and workpiece 190 as, for example, shown in FIG. 5. As such, the portion of workpiece 190, extending between first anvil 110 and second anvil 120, is accessible to each processing component of annular body 130. In one or more examples, the maximum dimension of first-anvil protrusion 115 along working axis 102 is greater than that of annular body 130 by between about 5% and 50% or, more specifically, by between about 10% and 30%.

Referring generally to FIGS. 1A and 1B and particularly to, e.g., FIG. 5, first-anvil protrusion 115 has a maximum dimension along working axis 102 that is at least one half of that of annular body 130. The preceding subject matter of this paragraph characterizes example 18 of the present disclosure, wherein example 18 also includes the subject matter according to example 16, above.

When the maximum dimension of first-anvil protrusion 115 along working axis 102 that is at least one half of that of annular body 130, first-anvil protrusion 115 protrudes through at least half of annular body 130 entirely. As such, external interface point 193 is reached and heated by at least heater 160 of annular body 130. In one or more examples, heater 160 is positioned in the middle of annular body 130 along working axis 102. In one or more examples, the maximum dimension of first-anvil protrusion 115 along working axis 102 is greater than one half that of annular body 130 by between about 5% and 50% or, more specifically, by between about 10% and 30%.

Referring generally to FIGS. 1A and 1B and particularly to, e.g., FIGS. 2A and 6, second anvil 120 comprises second-anvil base 127 and second-anvil protrusion 125, extending from second-anvil base 127 toward first anvil 110 along working axis 102. Second-anvil protrusion 125 has a diameter that is smaller than that of second-anvil base 127 and that is smaller than that of central opening 147 of annular body 130. The preceding subject matter of this paragraph characterizes example 19 of the present disclosure, wherein example 19 also includes the subject matter according to any one of examples 16 to 18, above.

The diameter of second-anvil protrusion 125 being smaller than the diameter of central opening 147 of annular body 130 enables second-anvil protrusion 125 to protrude into central opening 147 as, for example, schematically shown in FIG. 6. This feature enables maximizing the processed length of workpiece 190. Specifically, in one or more examples, a portion of workpiece 190, extending between first anvil 110 and second anvil 120, is accessible to each processing component of annular body 130. In one or more examples, the diameter of second-anvil protrusion 125 is the same as the diameter of the portion of workpiece 190, extending between first anvil 110 and second anvil 120 and not engaged by first anvil 110 and second anvil 120. This ensures continuity of the seal when second total-loss convective chiller 150 faces second-anvil protrusion 125, e.g., past external interface point 196 between first-anvil protrusion 115 and workpiece 190.

Referring generally to FIGS. 1A and 1B and particularly to, e.g., FIG. 6, second-anvil protrusion 125 has a maximum dimension along working axis 102 that is equal to that of annular body 130. The preceding subject matter of this paragraph characterizes example 20 of the present disclosure, wherein example 20 also includes the subject matter according to example 19, above.

When the maximum dimension of second-anvil protrusion 125 along working axis 102 that is equal to or greater than that of annular body 130, second-anvil protrusion 125 protrudes through annular body 130 entirely. As such, all three operating components of annular body 130 pass external interface point 193 between second-anvil protrusion 125 and workpiece 190. As such, the portion of workpiece 190, extending between first anvil 110 and second anvil 120, is accessible to each processing component of annular body 130. In one or more examples, the maximum dimension of second-anvil protrusion 125 along working axis 102 is greater than that of annular body 130 by between about 5% and 50% or, more specifically, by between about 10% and 30%.

Referring generally to FIGS. 1A and 1B and particularly to, e.g., FIG. 6, second-anvil protrusion 125 has a maximum dimension along working axis 102 that is equal to or greater than one half of that of annular body 130. The preceding subject matter of this paragraph characterizes example 21 of the present disclosure, wherein example 21 also includes the subject matter according to example 20, above.

When the maximum dimension of second-anvil protrusion 125 along working axis 102 that is at least one half of that of annular body 130, second-anvil protrusion 125 protrudes through at least half of annular body 130 entirely. As such, external interface point 193 is reached and heated by at least heater 160 of annular body 130. In one or more examples, heater 160 is positioned in the middle of annular body 130 along working axis 102. In one or more examples, the maximum dimension of second-anvil protrusion 125 along working axis 102 is greater than one half that of annular body 130 by between about 5% and 50% or, more specifically, by between about 10% and 30%.

Referring generally to FIGS. 1A and 1B and particularly to, e.g., FIGS. 2A, 5, and 6, high-pressure-torsion apparatus 100 further comprises linear actuator 170, coupled to annular body 130 and operable to move heater 160, first total-loss convective chiller 140, and second total-loss convective chiller 150 between first anvil 110 and second anvil 120 along working axis 102. The preceding subject matter of this paragraph characterizes example 22 of the present disclosure, wherein example 22 also includes the subject matter according to any one of examples 1 to 21, above.

High-pressure-torsion apparatus 100 designed to process a separate portion of workpiece 190 at a time. This portion is defined by operating temperature zone 400 and, in one or more examples, is smaller than a part of workpiece 190 extending between first anvil 110 and second anvil 120 along working axis 102. To process other portions of workpiece 190, heater 160, first total-loss convective chiller 140, and second total-loss convective chiller 150 are moved between first anvil 110 and second anvil 120 along working axis 102. Linear actuator 170 is coupled to annular body 130 to provide this movement.

In one or more examples, linear actuator 170 is configured to move heater 160, first total-loss convective chiller 140, and second total-loss convective chiller 150 in a continuous manner while one or more of heater 160, first total-loss convective chiller 140, and second total-loss convective chiller 150 are operational. The linear speed, with which linear actuator 170 moves heater 160, first total-loss convective chiller 140, and second total-loss convective chiller 150, depends, in part, on the size of operating temperature zone 400 and the processing time for each processed portion. The heating output of heater 160 and the cooling outputs of first total-loss convective chiller 140, and/or second total-loss convective chiller 150 are kept constant while linear actuator 170 moves heater 160, first total-loss convective chiller 140, and second total-loss convective chiller 150.

Alternatively, linear actuator 170 is configured to move heater 160, first total-loss convective chiller 140, and second total-loss convective chiller 150 in an intermittent manner, which can be also referred to as "stop-and-go". In these examples, heater 160, first total-loss convective chiller 140, and second total-loss convective chiller 150 are moved from one location to another location, corresponding to different portions of workpiece 190, and are kept stationary in each location while the corresponding portion of the workpiece is being processed. In more specific examples, at least one of heater 160, first total-loss convective chiller 140, and/or second total-loss convective chiller 150 is not operational while moving from one location to another. At least, the heating output of heater 160 and the cooling outputs of first total-loss convective chiller 140, and/or second total-loss convective chiller 150 are reduced while linear actuator 170 moves heater 160, first total-loss convective chiller 140, and second total-loss convective chiller 150.

Referring generally to FIGS. 1A and 1B and particularly to, e.g., FIG. 2A, high-pressure-torsion apparatus 100 further comprises controller 180, communicatively coupled with linear actuator 170 and configured to control at least one of position or translational speed of annular body 130 along working axis 102. The preceding subject matter of this paragraph characterizes example 23 of the present disclosure, wherein example 23 also includes the subject matter according to example 22, above.

Controller 180 is used to ensure that various process parameters associated with modifying material properties of workpiece 190 are kept within predefined ranges. In one or more examples, controller 180 controls at least one of position or translational speed of annular body 130 along working axis 102 to ensure that each portion of workpiece 190, between first anvil 110 and second anvil 120, is processed in accordance with pre-specified processing parameters. For example, the translational speed of annular body 130 determines how long each portion is subjected to the heating action of heater 160 and cooling actions of one or both of first total-loss convective chiller 140 and second total-loss convective chiller 150. Furthermore, in one or more examples, controller 180 control s the heating output of heater 160 and the cooling outputs of first total-loss convective chiller 140, and/or second total-loss convective chiller 150.

Referring generally to FIGS. 1A and 1B and particularly to, e.g., FIG. 2A, high-pressure-torsion apparatus 100 further comprises at least one of heater temperature sensor 169, first-chiller temperature sensor 149, or second-chiller temperature sensor 159, communicatively coupled with controller 180. Heater temperature sensor 169 is configured to measure temperature of portion of surface 194 of workpiece 190, thermally coupled with heater 160. First-chiller temperature sensor 149 is configured to measure temperature of portion of surface 194 of workpiece 190, thermally coupled with first total-loss convective chiller 140. Second-chiller temperature sensor 159 is configured to measure temperature of portion of surface 194 of workpiece 190, thermally coupled with second total-loss convective chiller 150. The preceding subject matter of this paragraph characterizes example 24 of the present disclosure, wherein example 24 also includes the subject matter according to example 23, above.

Controller 180 uses inputs from one or more of heater temperature sensor 169, first-chiller temperature sensor 149, or second-chiller temperature sensor 159 to ensure that workpiece 190 is processed in accordance with desired parameters, such as temperature of the processed portion. Specifically, these inputs are used, in one or more examples, to ensure a particular shape of operating temperature zone 400 within workpiece 190 as, for example, schematically shown in FIG. 4A. In one or more examples, controller 180 controls the heating output of heater 160 and the cooling outputs of first total-loss convective chiller 140, and/or second total-loss convective chiller 150 based on inputs from one or more of heater temperature sensor 169, first-chiller temperature sensor 149, or second-chiller temperature sensor 159.

Referring generally to FIGS. 1A and 1B and particularly to, e.g., FIG. 2A, controller 180 is communicatively coupled with at least one of heater 160, first total-loss convective chiller 140, or second total-loss convective chiller 150. Controller 180 is further configured to control operation of at least one of heater 160, first total-loss convective chiller 140, or second total-loss convective chiller 150 based on input, received from at least one of heater temperature sensor 169, first-chiller temperature sensor 149, or second-chiller temperature sensor 159. The preceding subject matter of this paragraph characterizes example 25 of the present disclosure, wherein example 25 also includes the subject matter according to example 24, above.

Controller 180 uses inputs from one or more of heater temperature sensor 169, first-chiller temperature sensor 149, or second-chiller temperature sensor 159 to control operations of first total-loss convective chiller 140, second total-loss convective chiller 150, and heater 160 thereby establishing a feedback control loop. Different factors impact how much cooling output is needed from each of first total-loss convective chiller 140 and second total-loss convective chiller 150 and how much heating output is needed from heater 160. The feedback control loop enables addressing these factors dynamically, during operation of high-pressure-torsion apparatus 100.

In one or more examples, the output of heater temperature sensor 169 is used to control heater 160, separately from other components. The output of first-chiller temperature sensor 149 is used to control first total-loss convective chiller 140, separately from other components. Finally, the output of second-chiller temperature sensor 159 is used to control second total-loss convective chiller 150, separately from other components. Alternatively, outputs of heater temperature sensor 169, first-chiller temperature sensor 149, or second-chiller temperature sensor 159 are analyzed collectively by controller 180 for integrated control of first total-loss convective chiller 140, second total-loss convective chiller 150, and heater 160.

Referring generally to FIGS. 1A and 1B and particularly to, e.g., FIG. 2A, controller 180 is further configured to control at least one of the position or the translational speed of annular body 130 along working axis 102. The preceding subject matter of this paragraph characterizes example 26 of the present disclosure, wherein example 26 also includes the subject matter according to example 25, above.

Another example of processing parameters is the processing duration, which is defined a as a period of time a portion of workpiece 190 is a part of operating temperature zone 400. Controller 180 controls at least one of the position or the translational speed of annular body 130 along working axis 102 (or both) to ensure that the processing duration is within the desired range. In one or more examples, controller 180 is coupled to linear actuator 170 to ensure this positional control.

Referring generally to FIGS. 1A and 1B and particularly to, e.g., FIGS. 2A, 2B, and 2C, first anvil 110 comprises first-anvil opening 119 for receiving first end 191 of workpiece 190. First-anvil opening 119 has a non-circular cross-section in a plane, perpendicular to working axis 102. The preceding subject matter of this paragraph characterizes example 27 of the present disclosure, wherein example 27 also includes the subject matter according to any one of examples 1 to 26, above.

The non-circular cross-section of first-anvil opening 119 ensures that first anvil 110 is able to engage receiving first end 191 of workpiece 190 and apply torque to first end 191 while twisting workpiece 190 about working axis 102. Specifically, the non-circular cross-section of first-anvil opening 119 ensures that first end 191 of workpiece 190 does not slip relative to first anvil 110 when torque is applied. The non-circular cross-section effectively eliminates the need for complex non-slip coupling capable of supporting torque transfer. Referring to FIG. 2B, the non-circular cross-section of opening 119 is oval, in one or more examples. Referring to FIG. 2C, the non-circular cross-section of opening 119 is rectangular, in one or more examples.

Referring generally to FIGS. 1A and 1B and particularly to, e.g., FIG. 2A, heater 160 is one of a resistive heater or an induction heater. The preceding subject matter of this paragraph characterizes example 28 of the present disclosure, wherein example 28 also includes the subject matter according to any one of examples 1 to 27, above.

The resistive heater or the induction heater are able to provide high heating output while occupying a small space between first total-loss convective chiller 140 and second total-loss convective chiller 150. The space between first total-loss convective chiller 140 and second total-loss convective chiller 150 determines the height of operating temperature zone 400, which needs to be minimized, in one or more examples. Specifically, a smaller height of operating temperature zone 400 requires lower torque and/or compression between first anvil 110 and second anvil 120.

Referring generally to FIGS. 1A and 1B and particularly to, e.g., FIGS. 4A and 7, high-pressure-torsion apparatus 100 comprises working axis 102, first anvil 110, second anvil 120, and heater 160. Second anvil 120 faces first anvil 110 and is spaced apart from first anvil 110 along working axis 102. First anvil 110 and second anvil 120 are translatable relative to each other along working axis 102. First anvil 110 and second anvil 120 are rotatable relative to each other about working axis 102. Heater 160 is movable between first anvil 110 and second anvil 120 along working axis 102 and is configured to selectively heat workpiece 190. The preceding subject matter of this paragraph characterizes example 29 of the present disclosure.

High-pressure-torsion apparatus 100 is configured to process workpiece 190 by heating a portion of workpiece 190 while applying compression and torque to workpiece 190 to this heated portion. By heating only a portion of workpiece 190, rather than heating and processing workpiece 190 in its entirety at the same time, all of high-pressure-torsion deformation is confined to the narrow heated layer only, imparting high strains needed for fine-grain development. This reduction in compression and torque translates into a design of high-pressure-torsion apparatus 100 that is less complex and costly. Furthermore, this reduction in compression and torque results in more precise control over processing parameters, such as temperature, compression load, torque, processing duration, and the like. As such, more specific and controlled material microstructures of workpiece 190. For example, ultrafine grained materials offer substantial advantage over coarser grained materials displaying higher strength and better ductility. Finally, high-pressure-torsion apparatus 100 is able to process workpiece 190 having much large dimensions, e.g., a length, extending along working axis 102 of high-pressure-torsion apparatus 100, than would otherwise be possible if workpiece 190 is processed in its entirety at the same time. Specifically, heater 160 is movable along working axis 102.

First anvil 110 and second anvil 120 are designed to engage and retain workpiece 190 at respective ends, e.g., first end 191 and second end 192. When workpiece 190 is engaged by first anvil 110 and second anvil 120, first anvil 110 and second anvil 120 are also used to apply compression force and torque to workpiece 190. One or both first anvil 110 and second anvil 120 are movable. In general, first anvil 110 and second anvil 120 are movable along working axis 102 relative to each other to apply the compression force and to engage workpieces having different lengths. First anvil 110 and second anvil 120 are also rotatable about working, axis 102 relative to each other. In one or more examples, at least one of first anvil 110 and second anvil 120 is coupled to drive 104 as, for example, schematically shown in FIG. 2A.

Heater 160 is configured to selectively heat workpiece 190 either through direct contact with workpiece 190 or radiation. In case of radiation heating, heater 160 is spaced away from workpiece 190, resulting in a gap between heater 160 and workpiece 190. Various heater types, such as a resistive heater, an induction heater, and the like, are within the scope of the present disclosure. In one or more examples, heating output of heater 160 is controllably adjustable. As noted above, heating output determines the shape of operating temperature zone 400.

Heater 160 is movable along working axis 102 to process different portions of workpiece 190. For example, FIG. 7 illustrates linear actuator 170 coupled to heater 160 to move heater 160. In one or more examples, heater 160 is moved along working axis 102 continuously while processing workpiece 190. The speed, with which heater 160 is moved in these examples, depends on the size of the processing portion and processing duration. Alternatively, heater 160 is moved from location to another, corresponding to different portions of workpiece 190. Heater 160 is not operational while heater 160 is being moved or at least the heating output of heater 160 is reduced. Furthermore, in these alternative examples, heater 160 is stationary while processing each portion of workpiece 190.

Referring generally to FIGS. 8A and 8B and particularly to, e.g., FIGS. 2A, 4A-4C, 5, and 6, method 800 of modifying material properties of workpiece 190 using high-pressure-torsion apparatus 100 is disclosed. High-pressure-torsion apparatus 100 comprises working axis 102, first anvil 110, second anvil 120, and annular body 130, comprising first total-loss convective chiller 140, second total-loss convective chiller 150, and heater 160, positioned between first total-loss convective chiller 140 and second total-loss convective chiller 150 along working axis 102. Method 800 comprises (block 810) compressing workpiece 190 along central axis 195 of workpiece 190 and, simultaneously with compressing workpiece 190 along central axis 195, (block 820) twisting workpiece 190 about central axis 195. Method 800 further comprises, while compressing workpiece 190 along central axis 195 and twisting workpiece 190 about central axis 195, (block 830) translating annular body 130 along working axis 102 of high-pressure-torsion apparatus 100, collinear with central axis 195 of workpiece 190, and (block 840) heating workpiece 190 with heater 160. The preceding subject matter of this paragraph characterizes example 30 of the present disclosure.

Method 800 utilizes a combination of compression, torque, and heat applied to a portion of workpiece 190, rather than workpiece 190 in its entirety. By heating only a portion of workpiece 190, rather than heating and processing workpiece 190 in its entirety at the same time, all of high-pressure-torsion deformation is confined to the narrow heated layer only, imparting high strains needed for fine-grain development. This reduction in compression and torque translates into a design of high-pressure-torsion apparatus 100 that is less complex and costly. Furthermore, this reduction in compression and torque results in more precise control over processing parameters, such as temperature, compression load, torque, processing duration, and the like. As such, more specific and controlled material microstructures of workpiece 190. For example, ultrafine grained materials offer substantial advantage over coarser grained materials displaying higher strength and better ductility. Finally, high-pressure-torsion apparatus 100 is able to process workpiece 190 having much large dimensions, e.g., a length, extending along working axis 102 of high-pressure-torsion apparatus 100, than would otherwise be possible if workpiece 190 were processed in its entirety at the same time.

A processed portion generally corresponds to a heated portion, defined, at least in part, by the position of heater 160 relative to workpiece 190 and the heating output of heater 160. While compression and torque are applied to workpiece 190 in its entirety, the modification of material properties primarily happens in the heated portion. More specifically, the modification happens in a processed portion, which has a temperature within a desired processing range, which is defined as operating temperature zone 400. Various examples of operating temperature zone 400 are shown in FIGS. 4A-4C.

According to method 800, (block 810) compressing workpiece 190 along central axis 195 is performed using first anvil 110 and second anvil 120, engaging and retaining workpiece 190 at respective ends, e.g., first end 191 and second end 192. At least one of first anvil 110 or second anvil 120 is coupled to drive 104 as, for example, schematically shown in FIG. 2A to provide the compression force. The compression force depends on the size of the processed portion (e.g., the height along central axis 195 and the cross-sectional area perpendicular to central axis 195), the material of workpiece 190, the temperature of the processed portion, and other parameters.

According to method 800, (block 820) twisting workpiece 190 about central axis 195 is performed simultaneously with (block 810) compressing workpiece 190 along central axis 195. According to method 800, (block 820) twisting workpiece 190 is also performed using first anvil 110 and second anvil 120. As described above, first anvil 110 and second anvil 120 engage and retain workpiece 190 at respective ends, and at least one of first anvil 110 and second anvil 120 is coupled to drive 104. Torque depends on the size of the processed portion (e.g., the height along central axis 195 and the cross-sectional area, perpendicular to central axis 195), the material of workpiece 190, the temperature of the processed portion, and other parameters.

According to method 800, (block 840) heating workpiece 190 with heater 160 is performed simultaneously with (block 810) compressing and (block 820) twisting workpiece 190. A combination of these steps results in changes of grain structure in at least the processed portion of workpiece 190. It should be noted that the processed portion experiences a higher temperature than the rest of workpiece 190. As such, grain structure changes in the rest of workpiece 190 do not occur or occur to a lesser degree. Furthermore, in one or more examples, (block 830) translating annular body 130 and (block 840) heating workpiece 190 with heater 160 are performed simultaneously with each other. In these examples, processing of workpiece 190 is performed in a continuous manner.

Heater 160 is configured to selectively heat workpiece 190, one portion at a time, either through direct contact with workpiece 190 or radiation. A specific combination of temperature, compression force, and torque applied, to a portion of workpiece results in changes to gain structure of the material, forming the processed portion. Heater 160 is movable along working axis 102 to process different portions of workpiece 190.

Referring generally to FIGS. 8A and 8B and particularly to, e.g., FIGS. 4A-4C, method 800 further comprises at least one of (block 850) cooling workpiece 190 with first total-loss convective chiller 140 or (block 860) cooling workpiece 190 with second total-loss convective chiller 150, simultaneously with heating workpiece 190. The preceding subject matter of this paragraph characterizes example 31 of the present disclosure, wherein example 31 also includes the subject matter according to example 30, above.

A combination of heater 160 and one or both of first total-loss convective chiller 140 and second total-loss convective chiller 150 enables controlling size and position of each processed portion, defined by operating temperature zone 400 as, for example, schematically shown in FIG. 4A. When heater 160 selective heats a portion of workpiece 190, workpiece 190 experiences internal heat transfer, away from the heated portion. Cooling one or both adjacent portions of workpiece 190 enables controlling the effects of this internal heat transfer.

In one or more examples, (block 850) cooling workpiece 190 with first total-loss convective chiller 140 and (block 860) cooling workpiece 190 with second total-loss convective chiller 150 are performed simultaneously. In other words, both first total-loss convective chiller 140 and second total-loss convective chiller 150 are operational at the same time. For example, annular body 130 is positioned away from first anvil 110 and second anvil 120 and heat sinking effects of first anvil 110 and second anvil 120 are negligible when processing portions of workpiece away from first anvil 110 and second anvil 120.

Alternatively, only one first total-loss convective chiller 140 and second total-loss convective chiller 150 is operational while the other one is turned off. In other words, only one of (block 850) cooling workpiece 190 with first total-loss convective chiller 140 and (block 860) cooling workpiece 190 with second total-loss convective chiller 150 is performed, simultaneously with (block 840) heating workpiece 190.

Referring generally to FIGS. 8A and 8B and particularly to, e.g., FIGS. 3A-3C, according to method 800, (block 850) cooling workpiece 190 with first total-loss convective chiller 140 comprises (block 852) routing first cooling fluid 198 through first total-loss convective chiller 140 and (block 854) contacting portion of workpiece 190 with first cooling fluid 198, exiting first total-loss convective chiller 140. According to method 800, (block 860) cooling workpiece 190 with second total-loss convective chiller 150 comprises (block 862) routing second cooling fluid 199 through second total-loss convective chiller 150 and (block 864) contacting portion of workpiece 190 with second cooling fluid 199, exiting second total-loss convective chiller 150. The preceding subject matter of this paragraph characterizes example 32 of the present disclosure, wherein example 32 also includes the subject matter according to example 31, above.

Direct contact between first cooling fluid 198 and workpiece 190 as well as between second cooling fluid 199 and workpiece 190 provides effective cooling of respective portions of workpiece 190, where these contacts occur. In one or more examples, first cooling fluid 198 is flown through first total-loss convective chiller 140 and discharged from first total-loss convective chiller 140 toward workpiece 190. When first cooling fluid 198 contacts workpiece 190, the temperature of first cooling fluid 198 is less than that of workpiece 190, at least at this location, resulting in cooling of the corresponding portion of workpiece 190. It should be noted that another portion of workpiece 190 is heated adjacent to this cooled portion and that workpiece 190 experiences internal heat transfer between the heated portion and the cooled portion. After contacting workpiece 190, first cooling fluid 198 is discharged into the environment. Similarly, second cooling fluid 199 is flown through second total-loss convective chiller 150 and discharged from second total-loss convective chiller 150 toward workpiece 190. When second cooling fluid 199 contacts workpiece 190, the temperature of second cooling fluid 199 is less than that of workpiece 190, at least at this location, resulting in cooling of another portion of workpiece 190. The heated portion of workpiece 190 is also adjacent to this second cooled portion. In one or more examples, the heated portion is positioned between two cooled portions.

Referring generally to FIGS. 8A and 8B and particularly to, e.g., FIGS. 4A-4C, according to method 800, (block 852) routing first cooling fluid 198 through first total-loss convective chiller 140 and (block 862) routing second cooling fluid 199 through second total-loss convective chiller 150 are independently controlled. The preceding subject matter of this paragraph characterizes example 33 of the present disclosure, wherein example 33 also includes the subject matter according to example 32, above.

Independent control of first total-loss convective chiller 140 and second total-loss convective chiller 150 enables providing different cooling outputs from first total-loss convective chiller 140 and second total-loss convective chiller 150. These different cooling outputs allow better control of the processing parameters, such as the shape of operating temperature zone 400 as schematically shown, for example, in FIGS. 4A-4C.

In one or more examples, shown in FIG. 4A, both first total-loss convective chiller 140 and second total-loss convective chiller 150 are operational, such that first cooling fluid 198 flows through first total-loss convective chiller 140 and second cooling fluid 199 flows through second total-loss convective chiller 150 at the same time. In specific examples, flow rates of first cooling fluid 198 and second cooling fluid 199 are the same. Alternatively, the flow rates are different. As such, in one or more examples, flow rates of first cooling fluid 198 and second cooling fluid 199 are independently controlled.

In other examples, only one first total-loss convective chiller 140 and second total-loss convective chiller 150 is operational. FIG. 4B illustrates an example where only first total-loss convective chiller 140 is operational while second total-loss convective chiller 150 is not operational. In this example, first cooling fluid 198 flows through first total-loss convective chiller 140 while second cooling fluid 199 does not flow through second total-loss convective chiller 150. FIG. 4C illustrates another example where only second total-loss convective chiller 150 is operational while first total-loss convective chiller 140 is not operational. In this example, second cooling fluid 199 flows through second total-loss convective chiller 150 while first cooling fluid 198 does not flow through first total-loss convective chiller 140.

Referring generally to FIGS. 8A and 8B and particularly to, e.g., FIGS. 3A-3C, according to method 800, each of first cooling fluid 198 and second cooling fluid 199 is a compressed gas. The preceding subject matter of this paragraph characterizes example 34 of the present disclosure, wherein example 34 also includes the subject matter according to example 33, above.

The compressed gas is used to cool workpiece 190 when discharged from first-chiller channel 143 and second-chiller channel 153 toward workpiece 190. Specifically, when the compressed gas is discharged from first-chiller-channel outlet 145, the compressed gas expands in the space between first total-loss convective chiller 140 and workpiece 190. This expansion causes the gas temperature to drop. A portion of workpiece 190 contacts this expanded and cooled gas, resulting in cooling of this portion. Similarly, when the compressed gas is discharged from second-chiller-channel outlet 155, the compressed gas expands and cools in the space between second total-loss convective chiller 150 and workpiece 190, resulting in cooling another portion of workpiece 190.

Some examples of the compressed gas, operable as first cooling fluid 198, used in first total-loss convective chiller 140, or second cooling fluid 199, used in second total-loss convective chiller 150, are compressed air and nitrogen. Once these gases are used for cooling workpiece 190, the gases are released to the environment. In one or more examples, different compressed gases are used in first total-loss convective chiller 140 and second total-loss convective chiller 150.

Referring generally to FIGS. 8A and 8B and particularly to, e.g., FIGS. 3A-3C, according to method 800, annular body 130 comprises central opening 147, configured to surround workpiece 190. According to method 800, (block 852) routing first cooling fluid 198 through first total-loss convective chiller 140 comprises (block 853) discharging first cooling fluid 198 into central opening 147. According to method 800, (block 862) routing second cooling fluid 199 through second total-loss convective chiller 150 comprises (block 863) discharging second cooling fluid 199 into central opening 147. The preceding subject matter of this paragraph characterizes example 35 of the present disclosure, wherein example 35 also includes the subject matter according to example 33 or 34, above.

Central opening 147 enables workpiece 190 to protrude through annular body 130 such that annular body 130 surrounds workpiece 190. As such, components of annular body 130 have access to the entire perimeter of workpiece 190. Specifically, first total-loss convective chiller 140 is operable to selectively cool a portion of workpiece 190 around the entire perimeter of workpiece 190 by (block 853) discharging first cooling fluid 198 into central opening 147. Similarly, heater 160 is operable to selectively heat another portion of workpiece 190 around the entire perimeter of workpiece 190. Finally, second total-loss convective chiller 150 is operable to selective cool yet another portion of workpiece 190 around the entire perimeter of workpiece 190 by (block 863) discharging second cooling fluid 199 into central opening 147. Furthermore, central opening 147 forms a space, between annular body 130 and workpiece 190, for first cooling fluid 198 and second cooling fluid 199 to be discharged into.

In one or more examples, annular body 130 and workpiece 190 have clearance fit to allow for annular body 130 to freely move relative to workpiece 190, especially when workpiece 190 radially expands during heating, More specifically, the gap between annular body 130 and workpiece 190, in the radial direction, is between 1 millimeter and 10 millimeters wide, around the entire perimeter or, more specifically, between 2 millimeters and 8 millimeters. In specific examples, the gap is uniform around the entire perimeter. Furthermore, the clearance fit accommodates the flow of first cooling fluid 198 between first total-loss convective chiller 140 and workpiece 190 and, separately, the flow of second cooling fluid 199 between second total-loss convective chiller 150 and workpiece 190.

Referring generally to FIGS. 8A and 8B and particularly to, e.g., FIGS. 3A-3C, according to method 800, first total-loss convective chiller 140 comprises first-chiller channel 143, having first-chiller-channel inlet 144 and first-chiller-channel outlet 145, spaced away from first-chiller-channel inlet 144. First-chiller-channel outlet 145 is directed at workpiece 190. Second total-loss convective chiller 150 comprises second-chiller channel 153, having second-chiller-channel inlet 154 and second-chiller-channel outlet 155, spaced away from second-chiller-channel inlet 154. Second-chiller-channel outlet 155 is directed at workpiece 190. The preceding subject matter of this paragraph characterizes example 36 of the present disclosure, wherein example 36 also includes the subject matter according to example 35, above.

Referring to FIGS. 3A and 3B, when first total-loss convective chiller 140 is operational, first cooling fluid 198 is supplied into first-chiller channel 143, through first-chiller-channel inlet 144. First cooling fluid 198 flows through first-chiller channel 143 and exits through first-chiller channel 143 through first-chiller-channel outlet 145. At this point, the temperature of first cooling fluid 198 is less than that of workpiece 190. First cooling fluid 198 contacts a portion of workpiece 190, resulting in cooling of that portion.

Referring to FIGS. 3A and 3C, when second total-loss convective chiller 150 is operational, second cooling fluid 199 is supplied into second-chiller channel 153, through second-chiller-channel inlet 154. Second cooling fluid 199 flows through second-chiller channel 153 and exits second-chiller channel 153 through second-chiller-channel outlet 155. At this point, the temperature of second cooling fluid 199 is less than that of workpiece 190. Second cooling fluid 199 contacts a portion of workpiece 190, resulting in cooling of that portion.

Each of first-chiller-channel inlet 144 and second-chiller-channel inlet 154 is configured to connect to a cooling-fluid source, such as a line or conduit, a compressed-gas cylinder, a pump, and the like. In more specific examples, first-chiller-channel inlet 144 and second-chiller-channel inlet 154 are connected to the same fluid source. Alternatively, different cooling fluid sources are connected to first-chiller-channel inlet 144 and second-chiller-channel inlet 154. In more specific examples, first cooling fluid 198 is different from second cooling fluid 199. Alternatively, first cooling fluid 198 and second cooling fluid 199 have the same composition. In one or more examples, flow rates of first cooling fluid 198 and second cooling fluid 199 are independently controlled.

Referring to an example shown in FIGS. 3A and 3B, first total-loss convective chiller 140 comprises multiple instances of first-chiller channel 143, each comprising first-chiller-channel inlet 144 and first-chiller-channel outlet 145. In this example, these channels are evenly distributed around the perimeter of annular body 130 about working axis 102, Using multiple channels provides cooling uniformity around the perimeter of workpiece 190. Similarly, referring to FIGS. 3A and 3C, second total-loss convective chiller 150 comprises multiple instances of second-chiller channel 153. Each of multiple channels comprises second-chiller-channel inlet 154 and second-chiller-channel outlet 155. These multiple channels are evenly distributed about working axis 102.

Referring generally to FIGS. 8A and 8B and particularly to, e.g., FIG. 31), according to method 800, (block 853) discharging first cooling fluid 198 into central opening 147 is controlled by first flow restrictor 142 at first-chiller-channel outlet 145, According to method 800, (block 863) discharging second cooling fluid 199 into central opening 147 is controlled by second flow restrictor 152 at second-chiller-channel outlet 155. The preceding subject matter of this paragraph characterizes example 37 of the present disclosure, wherein example 37 also includes the subject matter according to example 36, above.

First flow restrictor 142 is used to restrict the flow of first cooling fluid 198 (e.g., a compressed gas) when first cooling fluid 198 is discharged from first-chiller channel 143. This flow restriction, in turn, is used to maintain different pressure levels of first cooling fluid 198 before and after the discharge, resulting in expansion and cooling of first cooling fluid 198 during the discharge. Similarly, second flow restrictor 152 is used to restrict the flow of second cooling fluid 199 (e.g., a compressed gas) when second cooling fluid 199 is discharged from second-chiller channel 153. This flow restriction, in turn, is used to maintain different pressure levels of second cooling fluid 199 before and after the discharge, resulting in expansion and cooling of second cooling fluid 199 during the discharge.

In one or more examples, first flow restrictor 142 and second flow restrictor 152 are integrated into first-chiller channel 143 and second-chiller channel 153, respectively. In more specific examples, first flow restrictor 142 is a narrowed portion of first-chiller channel 143 positioned at first-chiller-channel outlet 145. Similarly, second flow restrictor 152 is a narrowed portion of second-chiller channel 153 positioned at second-chiller-channel outlet 155, Alternatively, first flow restrictor 142 and second flow restrictor 152 are removable and replaceable. For examples, first flow restrictor 142 is replaced with another flow restrictor that, for example, has a different size orifice and, as a result, different cooling level.

Referring generally to FIGS. 8A and 8B and particularly to, e.g., FIGS. 3A-3C, according to method 800, (block 853) discharging first cooling fluid 198 into central opening 147 is controlled by first expansion valve 141 at first-chiller-channel outlet 145. According to method 800, (block 863) discharging second cooling fluid 199 into central opening 147 is controlled by second expansion valve 151 at second-chiller-channel outlet 155. The preceding subject matter of this paragraph characterizes example 38 of the present disclosure, wherein example 38 also includes the subject matter according to example 36, above.

First expansion valve 141 is used to controllably restrict the flow of first cooling fluid 198. This flow control results in different pressure levels of first cooling fluid 198 before and after discharge from first-chiller channel 143 and different cooling power of first total-loss convective chiller 140. Overall, the flow rate of first cooling fluid 198 and the pressure differential (before and after the expansion of first cooling fluid 198) is at least partially controlled by first expansion valve 141. Similarly, second expansion valve 151 is used to controllably restrict the flow of second cooling fluid 199. This flow control results in different pressure levels of second cooling fluid 199 before and after discharge from second-chiller channel 153 and different cooling power of second total-loss convective chiller 150. Overall, the flow rate of second cooling fluid 199 and the pressure differential (before and after the expansion of second cooling fluid 199) is at least partially controlled by second expansion valve 151.

In one or more examples, first expansion valve 141 and second expansion valve 151 are independently controlled, resulting in different cooling powers of first total-loss convective chiller 140 and second total-loss convective chiller 150. Each of first expansion valve 141 and second expansion valve 151 is operable to be fully open, fully close, or have multiple different intermediate positions.

Referring generally to FIGS. 8A and 8B and particularly to, e.g., FIGS. 3A and 3D, according to method 800, high-pressure-torsion apparatus 100 further comprises first thermal seal 131 and second thermal seal 132. First thermal seal 131 is located between heater 160 and first-chiller-channel outlet 145 along working axis 102 and is in contact with workpiece 190, such that first thermal seal 131 prevents first cooling fluid 198 from flowing into space between heater 160 and workpiece 190. Second thermal seal 132 is located between heater 160 and second-chiller-channel outlet 155 along working axis 102 and is in contact with workpiece 190, such that second thermal seal 132 prevents second cooling fluid 199 from flowing into space between heater 160 and workpiece 190. The preceding subject matter of this paragraph characterizes example 39 of the present disclosure, wherein example 39 also includes the subject matter according to any one of examples 36 to 38, above.

First thermal seal 131 prevents first cooling fluid 198, delivered from first-chiller-channel outlet 145 to workpiece 190, from entering the space between heater 160 and workpiece 190. It should be noted that heater 160 is positioned proximate to first-chiller-channel outlet 145. Similarly, second thermal seal 132 prevents second cooling fluid 199, delivered from second-chiller-channel outlet 155 to workpiece 190, from entering the same space between heater 160 and workpiece 190. As a result, the efficiency of heater 160 is maintained even when first-chiller-channel outlet 145 and/or second-chiller-channel outlet 155 is operational.

In one or more examples, when workpiece 190 protrudes through annular body 130, each of first thermal seal 131 and second thermal seal 132 directly contacts and is sealed against both annular body 130 and workpiece 190. First thermal seal 131 and second thermal seal 132 remain sealed again workpiece 190 even when first thermal seal 131 and second thermal seal 132 are translated together with annular body 130 along working axis 102 relative to workpiece 190. In one or more examples, first thermal seal 131 and second thermal seal 132 are formed from an elastic material, such as rubber.

Referring generally to FIGS. 8A and 8B and particularly to, e.g., FIGS. 3A and 3D, method 800 further comprises (block 870) thermally conductively isolating heater 160 and first total-loss convective chiller 140, from each other, using first thermal barrier 137, while (block 840) heating workpiece 190 with heater 160 is performed simultaneously with at least one of (block 850) cooling workpiece 190 with first total-loss convective chiller 140 or (block 860) cooling workpiece 190 with second total-loss convective chiller 150. The preceding subject matter of this paragraph characterizes example 40 of the present disclosure, wherein example 40 also includes the subject matter according to example 39, above.

First thermal barrier 137 reduces heat transfer between heater 160 and first total-loss convective chiller 140 thereby improving heating efficiency of heater 160 and cooling efficiency of first total-loss convective chiller 140. In one or more examples, first thermal barrier 137 is formed from a heat-insulating material, e.g., a material with a thermal conductivity of less than 1 W/m*K. Some examples of suitable material for first thermal barrier 137 are fiberglass, mineral wool, cellulose, polymer foams (e.g., polyurethane foam, polystyrene foam). In one or more examples, the thickness of first thermal barrier 137 is small, e.g., less than 10 millimeters or even less than 5 millimeters. The small thickness of first thermal barrier 137 and/or second thermal barrier 138 ensures that the distance between heater 160 and first total-loss convective chiller 140 is small thereby reducing the height of operating temperature zone 400.

Referring generally to FIGS. 8A and 8B and particularly to, e.g., FIGS. 3A and 3D, according to method 800, first thermal barrier 137 contacts first thermal seal 131. The preceding subject matter of this paragraph characterizes example 41 of the present disclosure, wherein example 41 also includes the subject matter according to example 40, above.

When first thermal barrier 137 contacts first thermal seal 131, the size of the cooled portion of workpiece is maximized. Specifically, first cooling fluid 198 does not pass first thermal seal 131. As such, first thermal seal 131 define the boundary of the cooling portion. At the same time, first thermal barrier 137 prevents direct heat transfer between first total-loss convective chiller 140 and heater 160. In one or more examples, first thermal barrier 137 provides axial support to first thermal seal 131 when first thermal seal 131 is moved relative to workpiece 190 along working axis 102.

In one or more examples, first thermal barrier 137 is adhered to first thermal seal 131. As such, first thermal barrier 137 is able to provide axial support to first thermal seal 131, when first thermal seal 131 is moved relative to workpiece 190 along working axis 102, in both axial directions.

Referring generally to FIGS. 8A and 8B and particularly to, e.g., FIGS. 3A and 3D, method 800 further comprises (block 875) thermally conductively isolating from each other heater 160 and second total-loss convective chiller 150 using second thermal barrier 138, while (block 840) heating workpiece 190 with heater 160 is performed simultaneously with at least one of (block 850) cooling workpiece 190 with first total-loss convective chiller 140 or (block 860) cooling workpiece 190 with second total-loss convective chiller 150. The preceding subject matter of this paragraph characterizes example 42 of the present disclosure, wherein example 42 also includes the subject matter according to any one of examples 39 to 41, above.

Second thermal barrier 138 reduces heat transfer between heater 160 and second total-loss convective chiller 150 thereby improving heating efficiency of heater 160 and cooling efficiency of second total-loss convective chiller 150. In one or more examples, second thermal barrier 138 is formed from a heat-insulating material, e.g., a material with a thermal conductivity of less than 1 W/m*K. Some examples of suitable material for second thermal barrier 138 are fiberglass, mineral wool, cellulose, polymer foams (e.g., polyurethane foam, polystyrene foam). In one or more examples, the thickness of second thermal barrier 138 is small, e.g., less than 10 millimeters or even less than 5 millimeters. The small thickness of second thermal barrier 138 ensures that the distance between heater 160 and second total-loss convective chiller 150 are small thereby reducing the height of operating temperature zone 400.

Referring generally to FIGS. 8A and 8B and particularly to, e.g., FIGS. 3A and 3D, according to method 800, second thermal barrier 138 contacts second thermal seal 132. The preceding subject matter of this paragraph characterizes example 43 of the present disclosure, wherein example 43 also includes the subject matter according to example 42, above.

When second thermal barrier 138 contacts second thermal seal 132, the size of the cooled portion of workpiece is maximized. Specifically, second cooling fluid 199 does not pass second thermal seal 132 in an axial direction along working axis 102. As such, second thermal seal 132 defines the boundary of the cooling portion. At the same time, second thermal barrier 138 prevents direct heat transfer between second total-loss convective chiller 150 and heater 160. Furthermore, in one or more examples, second thermal barrier 138 provides axial support to second thermal seal 132 when second thermal seal 132 is moved relative to workpiece 190 along working axis 102.

In one or more examples, second thermal barrier 138 is adhered to second thermal seal 132, As such, second thermal barrier 138 is able to provide axial support to second thermal seal 132, when second thermal seal 132 is moved relative to workpiece 190 along working axis 102, in both axial directions.

Referring generally to FIGS. 8A and 8B and particularly to, e.g., FIGS. 4A-4C, according to method 800, (block 840) heating workpiece 190 with heater 160 is independent from (block 850) cooling workpiece 190 with first total-loss convective chiller 140 or (block 860) cooling workpiece 190 with second total-loss convective chiller 150. The preceding subject matter of this paragraph characterizes example 44 of the present disclosure, wherein example 44 also includes the subject matter according to any one of examples 31 to 43, above.

The shape of operating temperature zone 400, schematically shown in FIGS. 4A-4C, is controlled, at least in part, by heating and cooling outputs of heater 160, first total-loss convective chiller 140, and second total-loss convective chiller 150. Independent operations of heater 160, first total-loss convective chiller 140, and second total-loss convective chiller 150 allow for more precise control of operating temperature zone 400. For examples, some portions of workpiece 190 are processed with all three of heater 160, first total-loss convective chiller 140, and second total-loss convective chiller 150 being operational. In other examples, other portions, e.g., proximate to first anvil 110 or second anvil 120, are processed with one of first total-loss convective chiller 140 or second total-loss convective chiller 150 being turned off.

Operations of first total-loss convective chiller 140 and second total-loss convective chiller 150 are individually controlled. Furthermore, cooling output of first total-loss convective chiller 140 is controllably variable. Likewise, cooling output of second total-loss convective chiller 150 is controllably variable.

Referring generally to FIGS. 8A and 8B and particularly to, e.g., FIGS. 4B and 4C, according to method 800, (block 840) heating workpiece 190 with heater 160 is performed while workpiece 190 is not cooled by at least one of first total-loss convective chiller 140 or second total-loss convective chiller 150. The preceding subject matter of this paragraph characterizes example 45 of the present disclosure, wherein example 45 also includes the subject matter according to example 44, above.

The shape of operating temperature zone 400, schematically shown in FIGS. 4B and 4C, is controlled, at least in part, by heating and cooling actions of heater 160, first total-loss convective chiller 140, and second total-loss convective chiller 150. The shape is also controlled by heat transfer within workpiece 190 and between workpiece 190 and other components engaging workpiece 190, such as first anvil 110 and second anvil 120. Referring to FIG. 4B, when heater 160 heats a portion of workpiece 190 positioned near or even engaged by second anvil 120, second anvil 120 also operates as a heat sink, resulting in a heat transfer from workpiece 190 to second anvil 120. In this example, second total-loss convective chiller 150, which is positioned closer to second anvil 120 than heater 160 or which is already positioned around second anvil 120 as shown in FIG. 4B, is turned off and not cooling workpiece 190. Alternatively, referring to FIG. 4C, second total-loss convective chiller 150, which is positioned closer to second anvil 120 than heater 160 or which is already positioned around second anvil 120, is turned on and cooling second anvil 120, e.g., to prevent damage to second anvil 120.

Operation of first total-loss convective chiller 140 and second total-loss convective chiller 150 is individually controlled. In one example, both first total-loss convective chiller 140 and second total-loss convective chiller 150 are operational and cooling respective portions of workpiece 190. In another example, one of first total-loss convective chiller 140 and second total-loss convective chiller 150 is operational while the other one of first total-loss convective chiller 140 and second total-loss convective chiller 150 is not operational. For example, first total-loss convective chiller 140 is not operational while second total-loss convective chiller 150 is operational, e.g., when annular body 130 approaches first anvil 110 and/or when first anvil 110 at least partially protrudes through annular body 130. Alternatively, first total-loss convective chiller 140 is operational while second total-loss convective chiller 150 is not operational, e.g., when annular body 130 approaches second anvil 120 and/or when second anvil 120 at least partially protrudes through annular body 130. Furthermore, in one or more examples, both first total-loss convective chiller 140 and second total-loss convective chiller 150 are not operational while heater 160 is operational. In one or more examples, the operation of each of first total-loss convective chiller 140 and second total-loss convective chiller 150 is controlled based on position of annular body 130 (e.g., relative to first anvil 110 or second anvil 120) and/or temperature feedback, as further described below. Furthermore, cooling output of first total-loss convective chiller 140 is controllably variable. Likewise, cooling output of second total-loss convective chiller 150 is controllably variable.

Referring generally to FIGS. 8A and 8B and particularly to, e.g., FIGS. 3A and 3D, method 800 further comprises (block 870) thermally conductively isolating from each other heater 160 and first total-loss convective chiller 140 using first thermal barrier 137 while (block 840) heating workpiece 190 with heater 160 is performed simultaneously with (block 850) cooling workpiece 190 with first total-loss convective chiller 140. The preceding subject matter of this paragraph characterizes example 46 of the present disclosure, wherein example 46 also includes the subject matter according to any one of examples 31 to 38, above.

First thermal barrier 137 reduces heat transfer between heater 160 and first total-loss convective chiller 140 while heater 160 and first total-loss convective chiller 140 are operational. Addition of first thermal barrier 137 between heater 160 and first total-loss convective chiller 140 results in (block 870) thermally conductively isolating heater 160 and first total-loss convective chiller 140 from each other using first thermal barrier 137. As a result, heating efficiency of heater 160 and cooling efficiency of first total-loss convective chiller 140 are improved.

In one or more examples, first thermal barrier 137 is formed from a heat-insulating material, e.g., a material with a thermal conductivity of less than 1 W/m*K. Some examples of suitable material for first thermal barrier 137 are fiberglass, mineral wool, cellulose, polymer foams (e.g., polyurethane foam, polystyrene foam). In one or more examples, the thickness of first thermal barrier 137 is small, e.g., less than 10 millimeters or even less than 5 millimeters. The small thickness of first thermal barrier 137 and/or second thermal barrier 138 ensures that the distance between heater 160 and first total-loss convective chiller 140 is small thereby reducing the height of operating temperature zone 400.

Referring generally to FIGS. 8A and 8B and particularly to, e.g., FIG. 3E, according to method 800, first thermal barrier 137 contacts workpiece 190. The preceding subject matter of this paragraph characterizes example 47 of the present disclosure, wherein example 47 also includes the subject matter according to example 46, above.

First thermal barrier 137 reduces heat transfer between heater 160 and first total-loss convective chiller 140 thereby improving heating efficiency of heater 160 and cooling efficiency of first total-loss convective chiller 140. Furthermore, when first thermal barrier 137 extends to and contacts workpiece 190 as, for example, is shown in FIG. 3E, first thermal barrier 137 also prevents flow of first cooling fluid 198 into the space between heater 160 and workpiece 190. In other words, first thermal barrier 137 is also operable as a seal.

In one or more examples, first thermal barrier 137 is formed from a heat-insulating material, e.g., a material with a thermal conductivity of less than of less than 1 W/m*K. Some examples of suitable material are fiberglass, mineral wool, cellulose, polymer foams (e.g., polyurethane foam, polystyrene foam). In one or more examples, the thickness of first thermal barrier 137 is small, e.g., less than 10 millimeters or even less than 5 millimeters to ensure that the distance between heater 160 and first total-loss convective chiller 140 is small. The proximity of first total-loss convective chiller 140 to heater 160 ensures that the height (axial dimension) of operating temperature zone 400 is small.

Referring generally to FIGS. 8A and 8B and particularly to, e.g., FIGS. 3A, 3D, and 3E, method 800 further comprises (block 875) thermally conductively isolating from each other heater 160 and second total-loss convective chiller 150 using second thermal barrier 138 while (block 840) heating workpiece 190 with heater 160 is performed simultaneously with (block 860) cooling workpiece 190 with second total-loss convective chiller 150. The preceding subject matter of this paragraph characterizes example 48 of the present disclosure, wherein example 48 also includes the subject matter according to example 46 or 47, above.

Second thermal barrier 138 reduces heat transfer between heater 160 and second total-loss convective chiller 150 thereby improving heating efficiency of heater 160 and cooling efficiency of second total-loss convective chiller 150. Addition of second thermal barrier 138 between heater 160 and second total-loss convective chiller 150 results in (block 875) thermally conductively isolating heater 160 and second total-loss convective chiller 150 from each other using second thermal barrier 138. As a result, heating efficiency of heater 160 and cooling efficiency of first total-loss convective chiller 140 are improved.

In one or more examples, second thermal barrier 138 is formed from a heat-insulating material, e.g., a material with a thermal conductivity of less than 1 W/m*K. Some examples of suitable material for second thermal barrier 138 are fiberglass, mineral wool, cellulose, polymer foams (e.g., polyurethane foam, polystyrene foam). In one or more examples, the thickness of second thermal barrier 138 is small, e.g., less than 10 millimeters or even less than 5 millimeters. The small thickness of second thermal barrier 138 ensures that the distance between heater 160 and second total-loss convective chiller 150 is small thereby reducing the height of operating temperature zone 400.

Referring generally to FIGS. 8A and 8B and particularly to, e.g., FIG. 3E, according to method 800, second thermal barrier 138 contacts workpiece 190. The preceding subject matter of this paragraph characterizes example 49 of the present disclosure, wherein example 49 also includes the subject matter according to example 48, above.

Second thermal barrier 138 reduces heat transfer between heater 160 and second total-loss convective chiller 150 thereby improving heating efficiency of heater 160 and cooling efficiency of second total-loss convective chiller 150. Furthermore, when second thermal barrier 138 extends to and contacts workpiece 190 as, for example, is shown in FIG. 3E, second thermal barrier 138 also prevents flow of second cooling fluid 199 into the space between heater 160 and workpiece 190. In other words, second thermal barrier 138 is also operable as a seal.

In one or more examples, second thermal barrier 138 is formed from a heat-insulating material, e.g., a material with a thermal conductivity of less than of less than 1 W/m*K. Some examples of suitable material are fiberglass, mineral wool, cellulose, polymer foams (e.g., polyurethane foam, polystyrene foam). In one or more examples, the thickness of second thermal barrier 138 is small, e.g., less than 10 millimeters or even less than 5 millimeters to ensure that the distance between heater 160 and second total-loss convective chiller 150 are small. The proximity of second total-loss convective chiller 150 to heater 160 ensures that the height (axial dimension) of operating temperature zone 400 is small.

Referring generally to FIGS. 8A and 8B and particularly to, e.g., FIG. 2A, method 800 further comprises (block 880) receiving, at controller 180 of high-pressure-torsion apparatus 100, input from heater temperature sensor 169, first-chiller temperature sensor 149, and second-chiller temperature sensor 159. Each of heater temperature sensor 169, first-chiller temperature sensor 149, and second-chiller temperature sensor 159 is communicatively coupled with controller 180. Method 800 additionally comprises (block 885) controlling, using controller 180, operations of at least one of heater 160, first total-loss convective chiller 140, or second total-loss convective chiller 150 based on the input from heater temperature sensor 169, first-chiller temperature sensor 149, and second-chiller temperature sensor 159. Each of heater 160, first total-loss convective chiller 140, and second total-loss convective chiller 150 is communicatively coupled with and controlled by controller 180. The preceding subject matter of this paragraph characterizes example 50 of the present disclosure, wherein example 50 also includes the subject matter according to any one of examples 31 to 49, above.

Controller 180 is used to ensure that various process parameters associated with modifying material properties of workpiece 190 are kept within predefined ranges. Specifically, controller 180 uses inputs from one or more of heater temperature sensor 169, first-chiller temperature sensor 149, or second-chiller temperature sensor 159 to ensure that workpiece 190 is processed in accordance with desired parameters, such as temperature of the processed portion. Specifically, these inputs are used, in one or more examples, to ensure a particular shape of operating temperature zone 400.

In one or more examples, the output of heater temperature sensor 169 is used to control heater 160, separately from other components. The output of first-chiller temperature sensor 149 is used to control first total-loss convective chiller 140, separately from other components. Finally, the output of second-chiller temperature sensor 159 is used to control second total-loss convective chiller 150, separately from other components. Alternatively, outputs of heater temperature sensor 169, first-chiller temperature sensor 149, or second-chiller temperature sensor 159 are analyzed collectively by controller 180 for integrated control of first total-loss convective chiller 140, second total-loss convective chiller 150, and heater 160.

Referring generally to FIGS. 8A and 8B and particularly to, e.g., FIGS. 2A, 5, and 6, according to method 800, (block 830) translating annular body 130 along working axis 102 of high-pressure-torsion apparatus 100 is performed using linear actuator 170, communicatively coupled to and controlled by controller 180. The preceding subject matter of this paragraph characterizes example 51 of the present disclosure, wherein example 51 also includes the subject matter according to example 50, above.

Heater 160, first total-loss convective chiller 140, and second total-loss convective chiller 150 are designed to process a separate portion of workpiece 190 at a time. This portion is defined by operating temperature zone 400 and, in one or more examples, is smaller than a part of workpiece 190, extending between first anvil 110 and second anvil 120 along working axis 102. To process additional portions of workpiece 190, heater 160, first total-loss convective chiller 140, and second total-loss convective chiller 150 are moved between first anvil 110 and second anvil 120 along working axis 102 using linear actuator 170.

In one or more examples, linear actuator 170 is configured to move heater 160, first total-loss convective chiller 140, and second total-loss convective chiller 150 in a continuous manner while one or more of heater 160, first total-loss convective chiller 140, and second total-loss convective chiller 150 are operational. The linear speed, with which linear actuator 170 moves heater 160, first total-loss convective chiller 140, and second total-loss convective chiller 150, depends, in part, on the size of operating temperature zone 400 and the processing time, required for each processed portion.

Alternatively, linear actuator 170 is configured to move heater 160, first total-loss convective chiller 140, and second total-loss convective chiller 150 in an intermittent manner, which can be also called a "stop-and-go" manner. In these examples, heater 160, first total-loss convective chiller 140, and second total-loss convective chiller 150 are moved from one location to another location, corresponding to different portions of workpiece 190, and are kept stationary in each location while the corresponding portion of the workpiece is being processed. In more specific examples, at least one of heater 160, first total-loss convective chiller 140, and/or second total-loss convective chiller 150 is not operational while moving from one location to another.

Referring generally to FIGS. 8A and 8B and particularly to, e.g., FIGS. 2A, 5, and 6, method 800 further comprises (block 890) engaging first end 191 of workpiece 190 with first anvil 110 of high-pressure-torsion apparatus 100 and (block 895) engaging second end 192 of workpiece 190 with second anvil 120 of high-pressure-torsion apparatus 100. According to method 800, (block 810) compressing workpiece 190 along central axis 195 of workpiece 190 and (block 820) twisting workpiece 190 about central axis 195 are performed using first anvil 110 and second anvil 120. The preceding subject matter of this paragraph characterizes example 52 of the present disclosure, wherein example 52 also includes the subject matter according to any one of examples 31 to 51, above.

Method 800 utilizes a combination of compression, torque, and heat applied to a portion of workpiece 190, rather than workpiece 190 in its entirety. By heating only a portion of workpiece 190, rather than heating and processing workpiece 190 in its entirety at the same time, all of high-pressure-torsion deformation is confined to the narrow heated layer only, imparting high strains needed for fine-grain development. This reduction in compression and torque translates into a design of high-pressure-torsion apparatus 100 that is less complex and costly. Furthermore, this reduction in compression and torque results in more precise control over processing parameters, such as temperature, compression load, torque, processing duration, and the like. As such, more specific and controlled material microstructures of workpiece 190.

According to method 800, (block 810) compressing workpiece 190 along central axis 195 is performed using first anvil 110 and second anvil 120, engaging and retaining workpiece 190 at respective ends, e.g., first end 191 and second end 192. At least one of first anvil 110 and second anvil 120 is coupled to drive 104 as, for example, schematically shown in FIG. 2A to provide the compression force. The compression force depends on the size of the processed portion (e.g., the height along central axis 195 and the cross-sectional area perpendicular to central axis 195), the material of workpiece 190, and other parameters. Similarly, (block 820) twisting workpiece 190 about central axis 195 is performed using first anvil 110 and second anvil 120, engaging and retaining workpiece 190 at respective ends, e.g., first end 191 and second end 192. Torque depends on the size of the processed portion (e.g., the length along central axis 195 and the cross-sectional area perpendicular to central axis 195), the material of workpiece 190, and other parameters.

Referring generally to FIGS. 8A and 8B and particularly to, e.g., FIG. 5, according to method 800, first anvil 110 comprises first-anvil base 117 and first-anvil protrusion 115, extending from first-anvil base 117 toward second anvil 120 along working axis 102. Annular body 130 comprises central opening 147. According to method 800, (block 830) translating annular body 130 along working axis 102 of high-pressure-torsion apparatus 100 comprises (block 832) advancing first-anvil protrusion 115 into central opening 147 of annular body 130. The preceding subject matter of this paragraph characterizes example 53 of the present disclosure, wherein example 53 also includes the subject matter according to example 52, above.

The diameter of first-anvil protrusion 115 being smaller than the diameter of central opening 147 of annular body 130 enables first-anvil protrusion 115 to protrude into central opening 147, e.g., when annular body 130 is advanced toward first-anvil base 117 as, for example, schematically shown in FIG. 5. This feature enables maximizing the processed length of workpiece 190. Specifically, in one or more examples, any portion of workpiece 190, extending between first anvil 110 and second anvil 120, is accessible to each processing component of annular body 130.

In one or more examples, the diameter of first-anvil protrusion 115 is the same as the diameter of the portion of workpiece 190, extending between first anvil 110 and second anvil 120 and not engaged by first anvil 110 and second anvil 120. This ensures continuity of the seal when first total-loss convective chiller 140 faces first-anvil protrusion 115, e.g., past external interface point 193 between first-anvil protrusion 115 and workpiece 190.

Referring generally to FIGS. 8A and 8B and particularly to, e.g., FIG. 5, according to method 800, (block 850) cooling workpiece 190 with first total-loss convective chiller 140 is discontinued while (block 832) advancing first-anvil protrusion 115 into central opening 147 of first total-loss convective chiller 140. The preceding subject matter of this paragraph characterizes example 54 of the present disclosure, wherein example 54 also includes the subject matter according to example 53, above.

First anvil 110 operates as a heat sink when a heated portion of workpiece 190 is proximate to first anvil 110, such as when first-anvil protrusion 115 is advanced into central opening 147 of first total-loss convective chiller 140. To preserve the shape of operating temperature zone 400, (block 850) cooling workpiece 190 with first total-loss convective chiller 140 is discontinued. The effect of the internal heat transfer is mitigated by first anvil 110 at that point. Operation of first total-loss convective chiller 140 and second total-loss convective chiller 150 is individually controlled.

Referring generally to FIGS. 8A and 8B and particularly to, e.g., FIG. 6, according to method 800, second anvil 120 comprises second-anvil base 127 and second-anvil protrusion 125, extending from second-anvil base 127 toward first anvil 110 along working axis 102. Annular body 130 comprises central opening 147. According to method 800, (block 830) translating annular body 130 along working axis 102 of high-pressure-torsion apparatus 100 comprises (block 834) advancing second-anvil protrusion 125 into central opening 147 of annular body 130. The preceding subject matter of this paragraph characterizes example 55 of the present disclosure, wherein example 55 also includes the subject matter according to any one of examples 52 to 54, above.

The diameter of second-anvil protrusion 125 being smaller than the diameter of central opening 147 of annular body 130 enables second-anvil protrusion 125 to protrude into central opening 147, e.g., when annular body 130 is advanced toward second-anvil base 127 as, for example, schematically shown in FIG. 5. This feature enables maximizing the processed length of workpiece 190. Specifically, in one or more examples, any portion of workpiece 190, extending between first anvil 110 and second anvil 120, is accessible to each processing component of annular body 130.

In one or more examples, the diameter of second-anvil protrusion 125 is the same as the diameter of the portion of workpiece 190, extending between first anvil 110 and second anvil 120 and not engaged by first anvil 110 and second anvil 120. This ensures sealing and other characteristics of high-pressure-torsion apparatus 100.

Referring generally to FIGS. 8A and 8B and particularly to, e.g., FIGS. 4B and 6, according to method 800, (block 860) cooling workpiece 190 with second total-loss convective chiller 150 is discontinued while (block 834) advancing second-anvil protrusion 125 into central opening 147 of second total-loss convective chiller 150. The preceding subject matter of this paragraph characterizes example 56 of the present disclosure, wherein example 56 also includes the subject matter according to example 55, above.

Second anvil 120 operates as a heat sink when a heated portion of workpiece 190 is proximate to second anvil 120, such as when second-anvil protrusion 125 is advanced into central opening 147 of second total-loss convective chiller 150. To preserve the shape of operating temperature zone 400, (block 860) cooling workpiece 190 with second total-loss convective chiller 150 is discontinued. The effect of the internal heat transfer is mitigated by second anvil 120 at that point. Operation of first total-loss convective chiller 140 and second total-loss convective chiller 150 is individually controlled.

Referring generally to FIGS. 8A and 8B and particularly to, e.g., FIGS. 2A-2C, according to method 800, first anvil 110 comprises first-anvil opening 119, engaging first end 191 of workpiece 190. First-anvil opening 119 has a non-circular cross-section in a plane, perpendicular to working axis 102. The preceding subject matter of this paragraph characterizes example 57 of the present disclosure, wherein example 57 also includes the subject matter according to any one of examples 52 to 56, above.

The non-circular cross-section of first-anvil opening 119 ensures that first anvil 110 is able to engage receiving first end 191 of workpiece 190 and apply torque to first end 191 while twisting workpiece 190 about working axis 102. Specifically, the non-circular cross-section of first-anvil opening 119 ensures that first end 191 of workpiece 190 does not slip relative to first anvil 110 when torque is applied. The non-circular cross-section effectively eliminates the need for complex non-slip coupling capable of supporting torque transfer.

Referring to FIG. 2B, the non-circular cross-section of opening 119 is oval, in one or more examples. Referring to FIG. 2C, the non-circular cross-section of opening 119 is rectangular, in one or more examples.

Referring generally to FIGS. 8A and 8B and particularly to, e.g., FIGS. 2A, 2D, and 2E, according to method 800, second anvil 120 comprises second-anvil opening 129, engaging second end 192 of workpiece 190. Second-anvil opening 129 has non-circular cross-section in a plane, perpendicular to working axis 102. The preceding subject matter of this paragraph characterizes example 58 of the present disclosure, wherein example 58 also includes the subject matter according to any one of examples 52 to 57, above.

The non-circular cross-section of second opening 129 ensures that second anvil 120 is able to engage receiving second end 192 of workpiece 190 and apply torque to second end 192 while twisting workpiece 190 about working axis 102. Specifically, the non-circular cross-section of second opening 129 ensures that second end 192 of workpiece 190 does not slip relative to second anvil 120 when torque is applied. The non-circular cross-section effectively eliminates the need for complex non-slip coupling, capable of supporting torque transfer.

Referring to FIG. 2D, the non-circular cross-section of second opening 129 is oval, in one or more examples. Referring to FIG. 2E, the non-circular cross-section of second opening 129 is rectangular, in one or more examples.

Examples of the present disclosure may be described in the context of aircraft manufacturing and service method 1100 as shown in FIG. 9 and aircraft 1102 as shown in FIG.

10. During pre-production, illustrative method 1100 may include specification and design (block 1104) of aircraft 1102 and material procurement (block 1106). During production, component and subassembly manufacturing (block 1108) and system integration (block 1110) of aircraft 1102 may take place. Thereafter, aircraft 1102 may go through certification and delivery (block 1112) to be placed in service (block 1114). While in service, aircraft 1102 may be scheduled for routine maintenance and service (block 1116). Routine maintenance and service may include modification, reconfiguration, refurbishment, etc. of one or more systems of aircraft 1102.

Each of the processes of illustrative method 1100 may be performed or carried out by a system integrator, a third party, and/or an operator (e.g., a customer). For the purposes of this description, a system integrator may include, without limitation, any number of aircraft manufacturers and major-system subcontractors; a third party may include, without limitation, any number of vendors, subcontractors, and suppliers; and an operator may be an airline, leasing company, military entity, service organization, and so on.

As shown in FIG. 10, aircraft 1102 produced by illustrative method 1100 may include airframe 1118 with a plurality of high-level systems 1120 and interior 1122. Examples of high-level systems 1120 include one or more of propulsion system 1124, electrical system 1126, hydraulic system 1128, and environmental system 1130. Any number of other systems may be included. Although an aerospace example is shown, the principles disclosed herein may be applied to other industries, such as the automotive industry. Accordingly, in addition to aircraft 1102, the principles disclosed herein may apply to other vehicles, e.g., land vehicles, marine vehicles, space vehicles, etc.

Apparatus(es) and method(s) shown or described herein may be employed during any one or more of the stages of the manufacturing and service method 1100. For example, components or subassemblies corresponding to component and subassembly manufacturing (block 1108) may be fabricated or manufactured in a manner similar to components or subassemblies produced while aircraft 1102 is in service (block 1114). Also, one or more examples of the apparatus(es), method(s), or combination thereof may be utilized during production stages 1108 and 1110, for example, by substantially expediting assembly of or reducing the cost of aircraft 1102. Similarly, one or more examples of the apparatus or method realizations, or a combination thereof, may be utilized, for example and without limitation while aircraft 1102 is in service (block 1114) and/or during maintenance and service (block 1116).

Different examples of the apparatus(es) and method(s) disclosed herein include a variety of components, features, and functionalities. It should be understood that the various examples of the apparatus(es) and method(s) disclosed herein may include any of the components, features, and functionalities of any of the other examples of the apparatus(es) and method(s) disclosed herein in any combination, and all of such possibilities are intended to be within the scope of the present disclosure.

Many modifications of examples set forth herein will come to mind to one skilled in the art to which the present disclosure pertains having the benefit of the teachings presented in the foregoing descriptions and the associated drawings.

Therefore, it is to be understood that the present disclosure is not to be limited to the specific examples illustrated and that modifications and other examples are intended to be included within the scope of the appended claims. Moreover, although the foregoing description and the associated drawings describe examples of the present disclosure in the context of certain illustrative combinations of elements and/or functions, it should be appreciated that different combinations of elements and/or functions may be provided by alternative implementations without departing from the scope of the appended claims. Accordingly, parenthetical reference numerals in the appended claims are presented for illustrative purposes only and are not intended to limit the scope of the claimed subject matter to the specific examples provided in the present disclosure.

What is claimed is:

1. A method of modifying material properties of a workpiece using a high-pressure-torsion apparatus, comprising a working axis, a first anvil, a second anvil, and an annular body, comprising a first total-loss convective chiller, a second total-loss convective chiller, and a heater, positioned between the first total-loss convective chiller and the second total-loss convective chiller along the working axis, the method comprising steps of:

compressing the workpiece along a central axis of the workpiece;

simultaneously with compressing the workpiece along the central axis, twisting the workpiece about the central axis;

while compressing the workpiece along the central axis and twisting the workpiece about the central axis, translating the annular body along the working axis of the high-pressure-torsion apparatus, collinear with the central axis of the workpiece, and heating the workpiece with the heater; and at least one of cooling the workpiece with the first total-loss convective chiller or a step of cooling the workpiece with the second total-loss convective chiller, simultaneously with the step of heating the workpiece, wherein:

the step of cooling the workpiece-with the first total-loss convective chiller-comprises steps of routing a first cooling fluid through the first total-loss convective chiller and contacting a portion of the workpiece with the first cooling fluid, exiting the first total-loss convective chiller; and the step of cooling the workpiece with the second total-loss convective chiller comprises steps of routing a second cooling fluid through the second total-loss convective chiller and contacting a portion of the workpiece with the second cooling fluid, exiting the second total-loss convective chiller.

2. The method according to claim 1, wherein the step of heating the workpiece with the heater is independent from the step of cooling the workpiece with the first total-loss convective chiller or the step of cooling the workpiece with the second total-loss convective chiller.

3. The method according to claim 2, wherein the step of heating the workpiece with the heater is performed while the workpiece is not cooled by at least one of the first total-loss convective chiller or the second total-loss convective chiller.

4. The method according to claim 1, wherein the step of routing the first cooling fluid through the first total-loss convective chiller and the step of routing the second cooling fluid through the second total-loss convective chiller are independently controlled.

5. The method according to claim 4, wherein:

the annular body comprises a central opening, configured to surround the workpiece;

the step of routing the first cooling fluid through the first total-loss convective chiller comprises a step of discharging the first cooling fluid into the central opening; and the step of routing the second cooling fluid through the second total-loss convective chiller comprises a step of discharging the second cooling fluid into the central opening.

6. The method according to claim 5, wherein:

the first total-loss convective chiller comprises a first-chiller channel, having a first-chiller-channel inlet and a first-chiller-channel outlet, spaced away from the first-chiller-channel inlet;

the first-chiller-channel outlet is directed at the workpiece;

the second total-loss convective chiller comprises a second-chiller channel, having a second-chiller-channel inlet and a second-chiller-channel outlet, spaced away from the second-chiller-channel inlet; and the second-chiller-channel outlet is directed at the workpiece.

7. The method according to claim 6, wherein:

the high-pressure-torsion apparatus further comprises:

a first thermal seal, located between the heater and the first-chiller-channel outlet along the working axis and in contact with the workpiece, such that the first thermal seal prevents the first cooling fluid from flowing into a space between the heater and the workpiece; and a second thermal seal, located between the heater and the second-chiller-channel outlet along the working axis and in contact with the workpiece, such that the second thermal seal prevents the second cooling fluid from flowing into a space between the heater and the workpiece.

8. The method according to claim 7, further comprising a step of thermally conductively isolating the heater and the first total-loss convective chiller from each other using a first thermal barrier while the step of heating the workpiece with the heater is performed simultaneously with at least one of the step of cooling the workpiece with the first total-loss convective chiller or the step of cooling the workpiece with the second total-loss convective chiller.

9. The method according to claim 7, further comprising a step of thermally conductively isolating from each other the heater and the second total-loss convective chiller using a second thermal barrier while the step of heating the workpiece with the heater, is performed simultaneously with at least one of the step of cooling the workpiece with the first total-loss convective chiller or the step of cooling the workpiece with the second total-loss convective chiller.

10. The method according to claim 6, wherein:

the step of discharging the first cooling fluid into the central opening is controlled by a first flow restrictor at the first-chiller-channel outlet; and the step of discharging the second cooling fluid into the central opening is controlled by a second flow restrictor at the second-chiller-channel outlet.

11. The method according to claim 6, wherein:

the step of discharging the first cooling fluid into the central opening is controlled by a first expansion valve at the first-chiller-channel outlet; and the step of discharging the second cooling fluid into the central opening is controlled by a second expansion valve at the second-chiller-channel outlet.

12. The method according to claim 8, wherein the first thermal barrier contacts the first thermal seal.

13. The method according to claim 9, wherein the second thermal barrier contacts the second thermal seal.

14. The method according to claim 1, further comprising:

engaging a first end of the workpiece with the first anvil of the high-pressure-torsion apparatus; and engaging a second end of the workpiece with the second anvil of the high-pressure-torsion apparatus, wherein the steps of compressing the workpiece along the central axis of the workpiece and twisting the workpiece about the central axis are performed using the first anvil and the second anvil.

15. The method according to claim 14, wherein:

the first anvil comprises a first-anvil base and a first-anvil protrusion, extending from the first-anvil base toward the second anvil along the working axis;

the annular body comprises a central opening; and the step of translating the annular body along the working axis of the high-pressure-torsion apparatus comprises advancing the first-anvil protrusion into the central opening of the annular body.

16. The method according to claim 15, wherein the step of cooling the workpiece with the first total-loss convective chiller is discontinued while advancing the first-anvil protrusion into the central opening of the first total-loss convective chiller.

17. The method according to claim 14, wherein:

the second anvil comprises a second-anvil base and a second-anvil protrusion, extending from the second-anvil base toward the first anvil along the working axis;

the annular body comprises a central opening; and the step of translating the annular body along the working axis of the high-pressure-torsion apparatus comprises advancing the second-anvil protrusion into the central opening of the annular body.

18. A method of modifying material properties of a workpiece using a high-pressure-torsion apparatus, comprising a working axis, a first anvil, a second anvil, and an annular body, comprising a first total-loss convective chiller, a second total-loss convective chiller, and a heater, positioned between the first total-loss convective chiller and the second total-loss convective chiller along the working axis, the method comprising steps of:

compressing the workpiece along a central axis of the workpiece;

simultaneously with compressing the workpiece along the central axis, twisting the workpiece about the central axis;

while compressing the workpiece along the central axis and twisting the workpiece about the central axis, translating the annular body along the working axis of the high-pressure-torsion apparatus, collinear with the central axis of the workpiece, and heating the workpiece with the heater; at least one of cooling the workpiece with the first total-loss convective chiller or cooling the workpiece with the second total-loss convective chiller, simultaneously with the heating of the workpiece, and thermally conductively isolating from each other the heater and the first total-loss convective chiller using a first thermal barrier while the step of heating the workpiece with the heater is performed simultaneously with the step of cooling the workpiece with the first total-loss convective chiller.

19. The method according to claim 18, wherein the first thermal barrier contacts the workpiece.

20. The method according to claim 18, further comprising a step of thermally conductively isolating from each other the heater and the second total-loss convective chiller using a second thermal barrier while the step of heating the workpiece with the heater is performed simultaneously with the step of cooling the workpiece with the second total-loss convective chiller.

21. The method according to claim 20, wherein the second thermal barrier contacts the workpiece.

22. A method of modifying material properties of a workpiece using a high-pressure-torsion apparatus, comprising a working axis, a first anvil, a second anvil, and an annular body, comprising a first total-loss convective chiller, a second total-loss convective chiller, and a heater, positioned between the first total-loss convective chiller and the second total-loss convective chiller along the working axis, the method comprising steps of:

compressing the workpiece along a central axis of the workpiece;

simultaneously with compressing the workpiece along the central axis, twisting the workpiece about the central axis;

while compressing the workpiece along the central axis and twisting the workpiece about the central axis, translating the annular body along the working axis of the high-pressure-torsion apparatus, collinear with the central axis of the workpiece, and heating the workpiece with the heater;

receiving, at a controller of the high-pressure-torsion apparatus, input from a heater temperature sensor, a first-chiller temperature sensor, and a second-chiller temperature sensor, and wherein each of the heater temperature sensor, the first-chiller temperature sensor, and the second-chiller temperature sensor is communicatively coupled with the controller; and controlling, using the controller, operations of at least one of the heater, the first total-loss convective chiller, or second total-loss convective chiller based on the input from the heater temperature sensor, the first-chiller temperature sensor, and the second-chiller temperature sensor, and wherein each of the heater, the first total-loss convective chiller, the second total-loss convective chiller is communicatively coupled with and controlled by the controller.

23. The method according to claim 22, wherein the step of translating the annular body along the working axis of the high-pressure-torsion apparatus is performed using a linear actuator, communicatively coupled to and controlled by the controller.

* * * * *